US007722043B2

(12) United States Patent
Takeuchi et al.

(10) Patent No.: US 7,722,043 B2
(45) Date of Patent: May 25, 2010

(54) GAME MEDIUM SHOOTING MECHANISM

(75) Inventors: Mitsushige Takeuchi, Tokyo (JP); Hitoshi Arisawa, Tokyo (JP)

(73) Assignee: Konami Digital Entertainment, Co., Ltd. (JP)

( * ) Notice: Subject to any disclaimer, the term of this patent is extended or adjusted under 35 U.S.C. 154(b) by 89 days.

(21) Appl. No.: 12/064,202

(22) PCT Filed: Aug. 4, 2006

(86) PCT No.: PCT/JP2006/315471

§ 371 (c)(1),
(2), (4) Date: Feb. 19, 2008

(87) PCT Pub. No.: WO2007/023661

PCT Pub. Date: Mar. 1, 2007

(65) Prior Publication Data

US 2009/0160128 A1 Jun. 25, 2009

(30) Foreign Application Priority Data

Aug. 26, 2005 (JP) ..... 2005-245911
Aug. 26, 2005 (JP) ..... 2005-245923

(51) Int. Cl.
*A63F 9/00* (2006.01)

(52) U.S. Cl. ..... 273/129 R; 273/129 S; 463/20

(58) Field of Classification Search ..... 273/108, 273/119 R, 119 A, 126 R, 126 A, 129 R, 273/129 Q, 129 AP, 129 S, 129 T, 129 V, 273/129 W, 138.1, 138.2, 138.3, 440, 447, 273/448; 463/16, 20, 46
See application file for complete search history.

(56) References Cited

U.S. PATENT DOCUMENTS 6,334,612 B1 * 1/2002 Wurz et al. ..... 273/143 R (Continued)

FOREIGN PATENT DOCUMENTS

JP 07-168969 A 7/1995

(Continued)

OTHER PUBLICATIONS

International Search Report PCT/JP2006/315471.

*Primary Examiner*—Raleigh W. Chiu
(74) *Attorney, Agent, or Firm*—Townsend and Townsend and Crew LLP

(57) ABSTRACT

It is an object to provide a game medium shooting mechanism in a game device that uses an approximately disk-shaped game medium, which makes it possible for a game player to easily shoot a medal and devote oneself to play the game even when the game player continuously shoots the medal for a long time.

The game medium shooting mechanism 100 includes an accumulating part 101 for accumulating an approximately disk-shaped game medium M, first sloped walls 104 and 106 that are continuously sloped up and extended from the accumulating part 101, a first shooter 108 that includes a first slot 108-1 for inserting the game medium M therein on a position adjacent to the first sloped walls 104 and 106, and a first guide 113 that is extended on the first sloped wall for making the game medium M slidingly roll into the first slot 108-1 under the gravity. When the game player slides the approximately disk-shaped game medium M that are accumulated on the accumulating part 101 upward along first sloped walls 104 and 106 that are continuously sloped up and extended from the accumulating part 101 and then releases the game medium M, the game medium M slidingly falls along the first sloped wall 106 under the gravity, and is caught by the first guide 113 that is extended on the first sloped wall.

Also, the first guide is configured to make the game medium M slidingly roll into the first slot under the gravity.

19 Claims, 16 Drawing Sheets

U.S. PATENT DOCUMENTS

| | | | | |
|---|---|---|---|---|
| 6,769,687 | B2 * | 8/2004 | Ohara et al. | 273/138.1 |
| 7,017,904 | B2 * | 3/2006 | Ohara et al. | 273/138.1 |
| 2003/0092481 | A1 | 5/2003 | Ohara et al. | |
| 2005/0046106 | A1 * | 3/2005 | Ohara et al. | 273/138.1 |

FOREIGN PATENT DOCUMENTS

| | | | |
|---|---|---|---|
| JP | 08-153243 | A | 6/1996 |
| JP | 2002-143390 | A | 5/2002 |
| JP | 2004-174127 | A | 6/2004 |
| JP | 2005-040515 | A | 2/2005 |
| JP | 2005-040592 | A | 2/2005 |

* cited by examiner

FIRST MODIFIED EXAMPLE

SECOND MODIFIED EXAMPLE

THIRD MODIFIED EXAMPLE

FOURTH MODIFIED EXAMPLE

FIFTH MODIFIED EXAMPLE

GAME MEDIUM SHOOTING MECHANISM

FIELD OF THE INVENTION

The present invention relates to a game medium shooting mechanism, and particularly relates to a shooting mechanism in a game device in which an approximately disk-shaped game medium such as a medal is used.

BACKGROUND ART

A game device has been generally known where an approximately spherical game medium such as a ball and/or an approximately disk-shaped game medium such as a medal are/is used therein. In the present application, a term "game medium" means a tangible entity that is used in performing a game. A pusher-typed game has been widely known as a typical example of a game device in which a medal is used as an approximately disk-shaped game medium. In this type of game device, a game player plays a game by shooting a game medium through a game medium shooting mechanism. Results of the game are influenced by the timing of the shooting of the game medium, the direction in which the game medium is shot, or the amount of the shot game medium. Accordingly, in addition to the quality of a game, that is, amusement of a game itself, ease of operation for shooting a game medium is an important factor for engrossing a game player in playing with the game device.

DISCLOSURE OF THE INVENTION

According to a known medal shooting mechanism, in a conventional pusher-type game machine in which a medal is used, a game player is required to manually move a medal from a medal accumulating part to a medal slot. When a game player continuously shoots medals for a long time, the game player gets tired. In addition, when the game player wears out their shooting nerves, the game player cannot concentrate on the game and cannot enjoy it.

When medal shooting is automated, a game player does not have a sense that the game player is actively playing a game. Therefore, a problem arises that the game player's fascination with the game is reduced, even if the game quality is high.

Accordingly, an object of the present invention is to provide a game medium shooting mechanism in a game device in which an approximately disk-shaped game medium is used, which does not have the above described problems.

Furthermore, an object of the present invention is to provide a game medium shooting mechanism in a game device in which an approximately disk-shaped game medium is used, where the medal shooting is easily performed, and where a game player may stay involved in a game, even if the game player continuously shoots medals for a long time.

Furthermore, an object of the present invention is to provide a game device with a game medium shooting mechanism in a game device in which an approximately disk-shaped game medium is used, where the medal shooting is easily performed, a game player does not get tired, and a game player is capable of getting involved in a game, even if the game player continuously shoots medals for a long time.

According to a first aspect of the present invention, a game medium shooting mechanism is provided, which at least includes an accumulating part on which an approximately disk-shaped game medium is accumulated, a first sloped wall that is continuously sloped up and extended from the accumulating part, a first shooter that has a first slot in which the game medium is inserted on a position continuously leading to the first sloped wall, and a first guide that is entirely sloped down and extended to the first slot and includes a sloped portion, which is sloped down to the first slot and is formed on at least a part thereof, on the first sloped portion, for making the game medium slidingly roll into the first slot under the influence of gravity.

The first guide may be configured to allow the game medium to slidingly roll into the first slot under the influence of gravity. In order to achieve the purpose, the first guide is configured to include a sloped portion that is sloped down to the first slot on at least a part thereof, and is configured to be entirely sloped down to the first slot. Here, being "entirely sloped down" means that the first guide is configured to include a sloped portion that is sloped to the first slot on at least a part thereof, and is configured to allow the game medium to slidingly roll into the first slot under the influence of gravity. It is only necessary for the potential energy of the game medium located in a position of the first guide to be greater than that of the game medium located in a position of the first slot. For example, even if a rising portion is formed in the intermediate portion of the first guide, when the kinetic energy of the game medium is greater than the sum of the potential energy and the frictional energy of the rising portion, the game medium climbs the rising portion with the momentum of the rotational movement performed so far and then rolls into the first slot. In addition, when a rising portion is formed in the intermediate portion of the first guide and the kinetic energy of the game medium is less than the sum of the potential energy and the frictional energy of the rising portion, this does not matter so long as the game medium is capable of climbing the rising portion and then rolling into the first slot by being pushed by another game medium rotationally moving from behind. In addition, the first guide may be sloped down and extended to the first slot in a linear, curvilinear, or stepwise shape.

When the game player slides the approximately disk-shaped game medium that are accumulated on the accumulating part upward along the first sloped wall that is continuously sloped up and extended from the accumulating part and then releases the game medium, the game medium slidingly falls along the first sloped wall under the influence of gravity, and is caught by the first guide that is extended on the first sloped wall. The first guide is configured to make the game medium slidingly roll into the first slot under the influence of gravity. When the game player slides the approximately disk-shaped game medium upward along the first sloped wall and then releases the game medium, the game medium slidingly falls along the first sloped wall under the influence of gravity, and is caught by the first guide that is extended on the first sloped wall. Then, the game medium slidingly rolls into the first slot of the first shooter along the first guide under the influence of gravity. When the game medium rolls along the first guide, the game medium is supposed to slide with respect to the first sloped wall. In other words, it is only necessary for a game player to slidingly move the game medium upward along the first sloped wall from the accumulating part and then release the game medium. Therefore, it is not required for a game player to manually catch and carry the game medium from the accumulating part to the first slot as is conventionally performed. In other words, this makes it more comfortable for a game player to move one's hand by making use of gravity.

Accordingly, even when a game player continuously shoots game media for a long time, it is possible to largely reduce the player's tiredness. In addition, a game player's nerves do not wear out, and thus the game player is capable of concentrating on the game itself and enjoying the game.

When the game player slidingly moves the game medium upward along the first sloped wall and then releases the game medium, the game medium slidingly falls along the first sloped wall under the influence of gravity, and is caught by the first guide that is extended on the first sloped wall. Then, the game medium slidingly rolls into the first slot of the first shooter along the first guide under the influence of gravity. Accordingly, the game player's tiredness can be reduced, even when the game player continuously shoots game media for a long time, without automating shooting of the game medium. Accordingly, the game may maintain the game player's interest for a long period of time, by allowing the game player to actively play the game.

According to a second aspect of the present invention, it is preferable that a first step forms the first guide on the first sloped wall. However, it is not required for the first guide to be formed by the first step.

It is only necessary for the first guide to have a function of catching the game medium that slidingly falls along the first sloped wall under the influence of gravity, and a function of making the game medium slidingly roll into the first slot along the first guide, also under the influence of gravity. However, it is required to slidingly move the game medium upward along the first sloped wall to a position higher than that of the first guide. Accordingly, it is preferable that the first guide blocks movement of the game medium when the game medium is slidingly moved up.

In consideration of this, it is preferable for the first step of the first guide to be formed on the first sloped wall. Note that it is important that the step surface of the first step faces upwards along the first sloped wall. With the configuration, it becomes easy to slidingly move the game medium upward along the first sloped wall across the first step. In addition, it becomes possible that the game medium slidingly falls along the first sloped wall and is then caught by the step surface of the first step, when the game medium is slidingly moved upward and is released by a game player. If the step surface of the first step faces downwards, it is impossible to block the game medium that slidingly moves upward along the first sloped wall, and it is also impossible to make the game medium slidingly roll into the first slot under the influence of gravity while catching the game medium.

It is possible to form the first step by configuring an area of the first sloped wall that is lower than the first step to have thickness greater than that an area of the first sloped wall that is higher than the first step. For example, the first sloped wall may be configured by combining a first flat plate that extends in both of the upper and lower areas and a second flat plate that extends only in the lower area. In addition, the first sloped wall may be configured such that only the upper area of the first flat plate extends in both of the upper and lower areas. In both cases, it is possible to successfully achieve the first sloped wall including the first step with an existing technique.

In addition, it is possible to configure the first step to extended on the first sloped wall toward the first slot. In this case, it is required to rotationally guide the game medium, which is caught by the first step, to reach the first slot along the first step under the influence of gravity. Therefore, it is possible that the first step is sloped downwards on the first sloped wall toward the first slot. Specifically, it is also possible to configure the first step to be linearly sloped downwards on the first sloped wall towards the first slot. In addition, it is also possible to configure the first step to be curvilinearly sloped downwards on the first sloped wall. Furthermore, it is also possible to configure the first step to be the combination of linear and curvilinear shapes. Note that it is preferable for the first step to have a minimum-required slope angle for rotationally guiding the game medium toward the first slot under the influence of gravity, regardless of a position in the first step where the game medium is caught.

Furthermore, it is required that the first step abuts the first slot so that the game medium slidingly rolls into the first slot under the influence of gravity. It is preferable that an abutment portion of the first step is disposed adjacent to the first slot. It is only necessary for the first step to be formed so that the game medium rolling along the first step finally rolls into the first slot, even when there is a gap between the abutment portion of the first step and the first slot. In order to achieve the configuration, it is required that the first slot of the first shooter to be adjacent to the first sloped wall.

In addition, the width of the step surface of the first step, i.e. the dimension of the first step, is determined such that the game medium slidingly falling along the first sloped wall can be caught. The minimum-required dimension of the first step depends on slope angle of the first sloped wall and thickness of the game medium. For example, when the first sloped wall is formed to have large slope angle, the width of the step surface of the first step is supposed to be greater than that in a case that the first sloped wall is formed to have small slope angle. Furthermore, when the width of the step surface of the first step is formed to be much less than thickness of the game medium, it is impossible to catch the game medium that slidingly falls along the first sloped wall. Thus the game medium slidingly falls to the accumulating part across the first step. As a result, it is impossible to insert the game medium into the first slot. Therefore, in consideration of the thickness of the game medium and the slope angle of the first sloped wall, the step surface of the first step is required to have the minimum-required width for catching the game medium that slidingly falls along the first sloped wall.

According to a third aspect of the present invention, it is preferable for the first step to have width approximately corresponding to the thickness of the single game medium.

Theoretically, in a case that the peripheral portion of the game medium is formed to have a non-rectangular cross-section so that the corners of the cross-section are formed to have rounds, there is a possibility that the game medium is allowed to be caught by the first step when width of the step surface of the first step is formed to be greater than or equal to the thickness of the round shaped portions. However, in a practical situation, there is a possibility that the game medium slidingly falling along the first sloped wall is not caught by the first step as a result of impact and/or vibration to be generated when the game medium makes contact with the first step. Therefore, the step surface of the first step is designed to have width greater than the theoretically minimum-required width. From the perspective, it is preferable to design the step surface of the first step to have width approximately corresponding to thickness of the single game medium. Note that it is not required to form the step surface of the first step to have width that is the same as thickness of the single game medium. In other words, it is only necessary for the step surface of the first step to have width such that the game medium is capable of rotationally moving on the step surface.

Furthermore, the angle of the step surface of the first step is preferably right angle or acute angle with respect to the first sloped wall. When the angle of the step surface of the first step is set to be obtuse angle with respect to the first sloped wall, there is a high possibility that the game medium that slidingly falls along the first sloped wall slidingly falls without being caught by the first step.

When slope angle of the first sloped wall is large, that is, when the first sloped wall is formed to have approximately right angle, it becomes difficult to slidingly move the game medium upward easily from the accumulating part along the first sloped wall. On the contrary, when slope angle of the first sloped wall is small, that is, when the first sloped wall is set to be approximately flat, it is easy to slidingly move the game medium upward from the accumulating part along the first sloped wall. However, after a game player releases the medal, the frictional force between the game medium and the first sloped walls is larger. Therefore, the game medium becomes less likely to slide and fall along the first sloped wall. In addition, the frictional force will be large when the game medium slidingly moves on the first sloped wall while rolling along the first step. Accordingly, there is a possibility that the game medium stops moving on the way to the first medal slot and thus cannot reach the first medal slot. Therefore, in consideration of the above, it is required to set slope angle of the first sloped wall to be neither nearly perpendicular nor nearly flat. For example, it is preferable to set the first sloped wall to have the slope angle of 20-70 degrees. Furthermore, it is more preferable to set it to have the slope angle of 30-60 degrees. Typically, slope angle of the first sloped wall may be approximately 45 degrees.

According to a fourth aspect of the present invention, the first guide may be configured to be entirely sloped downwards and extends into the first slot from a lateral portion of the first sloped wall. In this case, the first guide is extended. Therefore, it becomes possible to reliably catch the game medium that slidingly falls along the first sloped wall.

Furthermore, according to a fifth aspect of the present invention, the first guide may be configured to be entirely sloped downwards and extend into the first slot. The first guide may extend from an inside position that is separated from a lateral portion of the first sloped wall positioned on the opposite side of the first slot at a distance greater than or equal to the diameter dimension of the single game medium. In this case, it becomes possible to slidingly move the game medium upward through an area of the first sloped wall where the first guide is not formed. Thus, it is not required to slidingly move the game medium upward across the first guide.

Furthermore, according to a sixth aspect of the present invention, it is preferable that a boundary of the accumulating part and the first sloped wall of the first aspect of the present invention is formed to be a curved surface.

With the configuration, it becomes possible to slidingly move the game medium to be accumulated on the accumulating part upward along the first sloped wall with the minimum resistance. The preferable curvature of the curved surfaces depends on diameter dimension of the game medium, but any curvature is possible as long as the curvature radius of the curved surfaces is sufficiently larger than diameter dimension of the game medium. It is possible to easily empirically decide the preferable curvature.

Furthermore, as described above, it is preferable to reduce the frictional resistance to be generated between the first sloped wall and the game medium as much as possible. The following configuration is effective for reducing the frictional resistance.

According to a seventh aspect of the present invention, it is preferable that the first sloped wall of the first aspect of the present invention includes at least one protrusion that is formed to reduce friction with the game medium slidingly-rolling along the first guide.

As described above, the game medium is formed in an approximately disk shape. Accordingly, when the first sloped wall includes a flat surface, the entire area of the lateral surface of the game medium makes contact with the flat surface of the first sloped wall. Reducing the contact area between the game medium and the first sloped wall effectively works to reduce the frictional force between the game medium and the first sloped wall. In order to reduce the contact area, it is preferable that the first sloped wall includes at least one protrusion that is formed to reduce friction with the game medium slidingly rolling along the first guide. When the lateral surface of the game medium makes contact with at least one protrusion, the contact area between the game medium and the first sloped wall will be reduced. It is important that the contact area between the game medium and the first sloped wall is reduced by the existence of the at least one protrusion. Furthermore, it is important that the at least one protrusion does not block the game medium that rolls along the first guide under the influence of gravity.

According to an eighth aspect of the present invention, a typical example of the at least one protrusion of the seventh aspect of the present invention may be made up of at least one ridge-shaped protrusion that is separated from the first guide at distance less than diameter of the game medium and that extends approximately in parallel with a direction in which the first guide extends. With the configuration, the game medium rolling along the first guide slidingly makes contact with the at least one ridge-shaped protrusion. Accordingly, the contact area between the game medium and the first sloped wall is reduced, and thus it becomes possible to effectively reduce the frictional force generated between the game medium and the first sloped wall. The ridge-shaped protrusion(s) may be made up of a single ridge-shaped protrusion or a plurality of ridge-shaped protrusions.

According to a ninth aspect of the present invention, a typical example of the at least one protrusion of the seventh aspect of the present invention may be formed as a plurality of protrusions scattered above the first guide, instead of the at least one ridge-shaped protrusion.

It is preferable to set intervals between adjacent protrusions to be sufficiently less than the diameter of the game medium. Furthermore, it is preferable to form the plurality of protrusions to be regularly scattered at predetermined intervals. With this configuration, the game medium rolling along the first guide slidingly makes contact with the plurality of scattered protrusions. Accordingly, the contact area between the game medium and the first sloped wall is reduced, and thus it becomes possible to effectively reduce the frictional force generated between the game medium and the first sloped wall. From the perspective of reduction of the frictional force, it is preferable to form the plurality of protrusions such that the top thereof is processed in a round shape.

According to a tenth aspect of the present invention, a first vibration device may be provided, which is configured to apply minute vibration to the first sloped wall of the first aspect of the present invention.

The game medium and the first sloped wall are prevented from closely making contact with each other by applying minute vibration to the first sloped wall for reducing the frictional force between the game medium and the first sloped wall. As a result, it becomes possible to reduce the effective contact area between the game medium and the first sloped wall and it also becomes possible to effectively reduce the frictional force. Various embodiments should avoid a situation where too much vibration is applied causing the game medium to instably rolls along the first guide. In addition, too much vibration is not preferable because it may make a game player uncomfortable. It is possible to form the first vibration device, which is configured to apply minute vibration to the first sloped wall, by a conventionally known vibration motor. However, the first vibration device is not necessarily limited to this.

According to an eleventh aspect of the present invention, the first sloped wall of the first aspect of the present invention may include a plurality of vent holes scattered above the first guide. A first ventilating device may be provided that is configured to provide airflow from the back side of the first sloped wall through the plurality of vent holes.

Buoyancy for floating the game medium from the first sloped wall is applied to the game medium by ventilation through the plurality of vent holes is another effective technique for reducing the frictional force to between the game medium and the first sloped wall. Accordingly, it is possible to reduce the contact force between the game medium and the first sloped wall, and as a result, the frictional force between the game medium and the first sloped wall is reduced. It is preferable to set intervals between adjacent vent holes to be sufficiently less than the diameter of the game medium. Furthermore, it is preferable to form the plurality of vent holes to be regularly scattered at predetermined intervals. In addition, the first ventilating device may be provided by disposing a ventilating fan on the back side of the first sloped wall. With the configuration, the game medium rolls along the first guide while the contact force between the game medium and the first sloped wall is reduced by the buoyancy applied by ventilation through the plurality of scattered vent holes. Therefore, it becomes possible to effectively reduce the frictional resistance to be generated between the game medium and the first sloped wall.

According to a twelfth aspect of the present invention, the first sloped wall of the first aspect of the present invention may be made up of a reticulated sloped wall. It is possible to provide a configuration that the first sloped wall is made up of a reticulate sloped wall as another effective technique for reducing the frictional force between the game medium and the first sloped wall. It is preferable that reticular grid intervals are set to be sufficiently less than the diameter of the game medium. Here, the first sloped wall is made up of a reticular sloped wall. Therefore, the contact area between the game medium and the first sloped wall is reduced, and thus it becomes possible to effectively reduce the frictional resistance between the game medium and the first sloped wall.

According to a thirteenth aspect of the present invention, it is preferable that the first slot of the first shooter of the first aspect of the present invention has dimension by which only one game medium is allowed to be inserted therein one at time. The configuration serves to reliably prevent a situation that a plurality of game media become stuck in a guide groove for guiding a game medium, when a plurality of game media are simultaneously inserted the first slot.

According to a fourteenth aspect of the present invention, it is preferable that at least surface of the first sloped wall of the first aspect of the present invention is made up of self-lubricating material. Only the surface may be formed with the material having the self-lubricating property, or the entirety of the first sloped wall may be formed with the material having the self-lubricating property. Furthermore, in addition to the first sloped wall, the surface or the entirety of the accumulating part may be also made of material having the self-lubricating property. It is possible to take engineering plastic such as Teflon (registered trademark) and oil-impregnated sintered metal (example of commercial product: oilless metal plate) as a typical example of the material having the self-lubricating property. However, the material is not necessarily limited to this.

According to a fifteenth aspect of the present invention, in addition to the above described elements of the first aspect of the present invention, the game medium shooting mechanism may be configured to further include a second sloped wall that is positioned on the opposite side from the first sloped wall through the accumulating part and is continuously sloped upwards and extends from the accumulating part, a second shooter that has a second slot in which the game medium is inserted on a position continuously leading to the second sloped wall, and a second guide that is entirely sloped downwards and extends to the second slot and includes a sloped wall that is sloped downwards to the second slot and is provided on at least a part of the second sloped wall for making the game medium slidingly roll into the second slot under the influence of gravity.

Here, it is only necessary for the second guide to be configured to allow the game medium to slidingly roll into the second slot under the influence of gravity. In order to achieve the purpose, the second guide is configured to include a sloped portion that is sloped downwards towards the second slot on at least a part thereof, and is configured to be entirely sloped down to the second slot. In short, being "entirely sloped down" means that the second guide is configured to include a sloped portion that is sloped toward the second slot on at least a part thereof, and is configured to allow the game medium to slidingly roll into the second slot under the influence of gravity. It is only necessary for the potential energy of the game medium that is located in a position of the second guide to be entirely greater than that of the game medium that is located in a position of the second slot. For example, even if a rising portion is formed in the intermediate portion of the second guide, when the kinetic energy of the game medium is greater than the sum of the potential energy and the frictional energy of the rising portion, the game medium climbs the rising portion with the momentum of the rotational movement performed so far and then rolls into the second slot. In addition, when a rising portion is formed in the intermediate portion of the second guide and the kinetic energy of the game medium is less than the sum of the potential energy and the frictional energy of the rising portion, this does not a matter so long as the game medium is capable of climbing the rising portion and then rolling into the second slot by being pushed by another game medium rotationally moving from behind. The second guide may be sloped downwards and extend into the second slot in a linear, curvilinear, or stepwise shape.

A configuration that a sloped wall is formed only on one side of the accumulating part may be provided for allowing the game medium to be shot to the accumulating part only from one direction. In addition, a configuration that sloped walls are formed on the both sides of the accumulating part may be provided for allowing the game medium to be shot to the accumulating part from the both directions. For the purpose of allowing the game medium to be shot from the both directions, it is preferable that the game medium shooting mechanism includes a second sloped wall that is positioned on the opposite side from the first sloped wall through the accumulating part. The second sloped wall should be continuously sloped upwards and extend from the accumulating part. The second sloped wall should include a second shooter that has a second slot in which the game medium is inserted on a position adjacent to the second sloped wall, and a second guide that extends along the second sloped wall for making the game medium slidingly roll into the second slot under the influence of gravity. The second sloped wall may be formed to have a structure that is the same as that of the above described first sloped wall, or may be formed to have a structure that is different from that of the above described first sloped wall. The structures of the first and second sloped wall include all the matters regarding the above described structure including the shooter and the guide.

According to a sixteenth aspect of the present invention, a game medium shooting mechanism is provided that includes at least an upper accumulating part upon which an approximately disk-shaped game medium is accumulated, a first lower accumulating part on which the game medium is accumulated, a first sloped wall that is interposed between the upper accumulating part and the first lower accumulating part and is sloped down and extends to the first lower accumulating part from the upper accumulating part, a first shooter that includes a first slot in which the game medium is inserted on a position continuously leading to the first sloped wall, and a first guide that is entirely sloped downwards and extends to the first slot and includes a sloped portion, which is sloped downwards to the first slot and is formed on at least a part of the first sloped wall, for making the game medium slidingly roll into the first slot under the influence of gravity.

Here, it is only necessary for the first guide to be configured to allow the game medium to slidingly roll into the first slot under the influence of gravity. In order to achieve the purpose, the first guide is configured to include a sloped portion that is sloped downwards to the first slot on at least a part thereof, and that is configured to be entirely sloped downwards to the first slot. Here, being "entirely sloped down" means that the first guide is configured to include a sloped portion that is sloped to the first slot on at least a part thereof, and is configured to allow the game medium to slidingly roll into the first slot under the influence of gravity. It is only necessary for the potential energy of the game medium located in a position of the first guide to be entirely greater than that of the game medium located in a position of the first slot. For example, even if a rising portion is formed in the intermediate portion of the first guide, when the kinetic energy of the game medium is greater than the sum of the potential energy and the frictional energy of the rising portion, the game medium climbs the rising portion with the momentum of the rotational movement performed so far and then rolls into the first slot. In addition, when a rising portion is formed in the intermediate portion of the first guide and the kinetic energy of the game medium is less than the sum of the potential energy and the frictional energy of the rising portion, this does not matter so long as the game medium is capable of climbing the rising portion and then rolling into the first slot by being pushed by another game medium rotationally moving from behind. In addition, the first guide may be sloped downwards and extend to the first slot in a linear, curvilinear, or stepwise shape.

When the game player, slides the approximately disk-shaped game medium, which are accumulated on the upper accumulating part, to the top area of the first sloped wall (that is continuously sloped down and extended to the first lower accumulating part from the upper accumulating part) and then releases the game medium, the game medium slidingly falls along the first sloped wall under the influence of gravity, and is caught by the first guide that extends along the first sloped wall. The first guide is configured to make the game medium slidingly roll into the first slot under the influence of gravity. When the game player moves the game medium to the top area of the first sloped wall that is continuously sloped downwards and extends to the first lower accumulating part from the upper accumulating part and then releases the game medium, the game medium slidingly falls along the first sloped wall under the influence of gravity, and is caught by the first guide that is extends along the first sloped wall. Then, the game medium slidingly rolls into the first slot of the first shooter along the first guide under the influence of gravity. When the game medium rolls along the first guide, the game medium is supposed to slide with respect to the first sloped wall. In other words, it is only necessary for a game player to slidingly move the game medium to the top area of the first sloped wall from the upper accumulating part and then release the game medium. Therefore, it is not required for a game player to manually catch and carry the game medium from the upper accumulating part to the first slot as is conventionally performed. In other words, this makes it easy for a game player to move their hand by making use of gravity.

Furthermore, there is a possibility that the game medium is not caught by the first guide. In this case, the game medium slidingly falls along the first sloped wall across the first guide and reaches the first lower accumulating part. Thus, the game medium is accumulated thereon. It is possible to use the game medium that is accumulated on the first lower accumulating part by moving it to the upper accumulating part. Alternatively, when the game player moves the game medium that is accumulated on the first lower accumulating part to the top area of the first sloped wall and then releases the game medium, the game medium slidingly falls along the first sloped wall under the influence of gravity, and is caught by the first guide that extends along the first sloped wall. Then, the game medium slidingly rolls into the first slot of the first shooter along the first guide under the influence of gravity. The mechanism is the same as that explained in the above described first aspect of the present invention.

Accordingly, even when a game player continuously shoots the game medium for a long time, it is possible to largely reduce game player's fatigue. In addition, a game player does not wear out their nerves for shooting the game medium, and thus the game player is capable of concentrating on the game itself and enjoying the game.

When the game player moves the game medium to the top area of the first sloped wall from the upper accumulating part and then releases the game medium, the game medium slidingly falls along the first sloped wall under the influence of gravity, and is caught by the first guide that extends along the first sloped wall. Then, the game medium slidingly rolls into the first slot of the first shooter along the first guide under the influence of gravity. Furthermore, when the game player slidingly moves the game medium, which slidingly falls along the first sloped wall without being caught by the first guide and is then accumulated on the first lower accumulating part, along the first sloped wall and then releases the game medium, the game medium slidingly falls along the first sloped wall under the influence of gravity, and is caught by the first guide that is extended on the first sloped wall. Then, the game medium slidingly rolls into the first slot of the first shooter along the first guide under the influence of gravity. In other words, it becomes possible to largely reduce the game player's tiredness even when the game player continuously shoots the game medium for a long time without automating shooting of the game medium. Accordingly, it becomes possible to maintain the game player's interest for a long time while the game player feels they are actively playing the game.

According to a seventeenth aspect of the present invention, it is preferable that the first guide of the sixteenth aspect of the present invention is formed by a first step that is formed on the first sloped wall. However, it is not required for the first guide to be formed by the step.

It is only necessary for the first guide to have a function of catching the game medium that slidingly falls along the first sloped wall under the influence of gravity, and a function of making the game medium slidingly roll into the first slot along the first guide under the influence of gravity. In a case where the game medium slidingly falls along the first sloped wall without being caught by the first guide it is accumulated on the first lower accumulating part, so the game player can slidingly move the game medium along the first sloped wall again up to a position higher than the first guide. It is preferable that existence of the first guide does not block movement of the game medium when the game medium is slidingly moved upward.

In consideration of this, it is preferable for the first guide to be formed by the first step that is formed on the first sloped wall. However, the first guide is not necessarily formed by the step. Note that it is important that the step surface of the first step faces upwards in a direction along the first sloped wall. With this configuration, it becomes easy to slidingly move the game medium upward along the first sloped wall across the first step. In addition, it becomes possible that the game medium slidingly falls along the first sloped wall and is then caught by the step surface of the first step, when the game medium once slidingly moved upward is released by a game player. When the step surface of the first step faces downwards, it is impossible to block the game medium that slidingly moves upward along the first sloped wall to be caught, and it is also impossible to make the game medium slidingly roll into the first slot under the influence of gravity while catching the game medium.

It becomes possible to successfully implement the first step by forming the area lower than the first step in the first sloped wall to have thickness greater than that of the area higher than the first step in the first sloped wall. For example, the first sloped wall may be configured by combining a first flat plate that extends in both of the upper and lower areas and a second flat plate that extends only in the lower area. In addition, the first sloped wall may be configured such that only the upper area of the first flat plate extends in both the upper and lower areas. In both cases, it is possible to successfully achieve the first sloped wall including the first step with an existing technique.

In addition, it is possible to configure the first step to extend along the first sloped wall toward the first slot. In this case, it is required to rotationally guide the game medium, which is caught by the first step, to reach the first slot along the first step under the influence of gravity. Therefore, it is typically possible to extend the first step to be sloped downwards along the first sloped wall towards the first slot. Specifically, it is also possible to configure the first step to be linearly sloped downwards along the first sloped wall towards the first slot. In addition, it is also possible to configure the first step to be curvilinearly sloped downwards along the first sloped wall. Furthermore, it is also possible to configure the first step by the combination of linear and curvilinear shapes. Note that it is preferable for the first step to have a minimum-required slope angle for rotationally guiding the game medium towards the first slot under the influence of gravity, regardless of a position in the first step where the game medium is caught.

Furthermore, it is required to form the first step to be disposed against the first slot such that the game medium slidingly rolls into the first slot under the influence of gravity. It is preferable that the abutment portion of the first step is disposed to be adjacent to the first slot. It is only necessary for the first step to be formed so that the game medium rolling along the first step finally rolls into the first slot even when the abutment portion of the first step is not disposed to be adjacent to the first slot (a gap is generated between the abutment portion and the first slot). In order to achieve the configuration, it is required for the first slot of the first shooter to be disposed adjacent to the first sloped wall.

In addition, the width of the step surface of the first step is determined such that the game medium slidingly falling along the first sloped wall can be caught by the step surface of the first step. The minimum-required dimension of the first step depends on slope angle of the first sloped wall and thickness of the game medium. For example, when the first sloped wall is formed to have large slope angle, the width of the step surface of the first step is supposed to be greater than that in a case where the first sloped wall is formed to have small slope angle. Furthermore, when the width of the step surface of the first step is formed to be much less than thickness of the game medium, it is impossible to catch the game medium that slidingly falls along the first sloped wall, and thus the game medium slidingly falls to the accumulating part across the first step. As a result, it is impossible to insert the game medium into the first slot. Therefore, in consideration of thickness of the game medium and slope angle of the first sloped wall, the step surface of the first step is required to have the minimum-required width for catching the game medium that slidingly falls along the first sloped wall.

According to an eighteenth aspect of the present invention, it is preferable for the step surface of the first step to have width approximately corresponding to thickness of the single game medium.

Theoretically, in a case that the peripheral portion of the game medium is formed to have a non-rectangular cross-section so that corners of the cross-section thereof are formed in a round shape, there is a possibility that the game medium is allowed to be caught by the first step when width of the step surface of the first step is formed to be greater than or equal to thickness of the round shaped portions. However, in a practical situation, there is a possibility that the game medium slidingly falling along the first sloped wall will not caught by the first step as a result of impact and/or vibration to be generated when the game medium makes contact with the first step. Therefore, the step surface of the first step is designed to have width greater than the theoretically minimum-required width. From this perspective, it is preferable to design the step surface of the first step to have width approximately corresponding to thickness of the single game medium. Note that it is not required to form the step surface of the first step to have width that is the same as thickness of the single game medium. In other words, it is only necessary for the step surface of the first step to have width such that the game medium is capable of rotationally moving on the step surface.

Furthermore, the angle of the step surface of the first step is preferably right angle or acute angle with respect to the first sloped wall. When the angle of the step surface of the first step is set to be obtuse angle with respect to the first sloped wall, there is a high possibility that the game medium that slidingly falls along the first sloped wall slidingly falls without being caught by the first step.

When slope angle of the first sloped wall is large, that is, when the first sloped wall is formed to have approximately right angle, it becomes difficult to slidingly move the game medium upward from the accumulating part along the first sloped wall. On the contrary, when slope angle of the first sloped wall is small, that is, when the first sloped wall is set to be approximately flat, it is easy to slidingly move the game medium upward from the accumulating part along the first sloped wall. However, after a game player releases the medal, the frictional force generated between the game medium and the first sloped walls will be increased. Therefore, the game medium becomes less easily slid along the first sloped wall. In addition, the frictional force will be large when the game medium slidingly moves on the first sloped wall while rolling along the first step. Accordingly, there is a possibility that the game medium will stop moving on the way towards the first medal slot, and that the game medium will not reach the first medal slot. Therefore, in consideration of the above, it is required to set slope angle of the first sloped wall to be neither nearly perpendicular nor nearly flat. For example, it is preferable to set the first sloped wall to have the slope angle of 20-70 degrees. Furthermore, it is more preferable to set it to have the slope angle of 30-60 degrees. Typically, slope angle of the first sloped wall may be approximately 45 degrees.

Furthermore, according to a nineteenth aspect of the present invention, the first guide may be configured to be entirely sloped downwards and extend into the first slot from a lateral portion of the first sloped wall, which is positioned on the opposite side of the first slot. In this case, the first guide extends along the entire area. Therefore, it becomes possible to reliably catch the game medium that slidingly falls along the first sloped wall.

Furthermore, according to a twentieth aspect of the present invention, the first guide may be configured to be entirely sloped downwards and extend into the first slot from an inside position that is separated from a lateral portion of the first sloped wall positioned on the opposite side of the first slot at distance greater than or equal to diameter dimension of the single game medium. In this case, it becomes possible for a game player to manually catch and slidingly move the game medium upward through an area of the first sloped wall where the first guide is not formed. Thus, it is not required for a game player to manually catch and slidingly move the game medium upward across the first guide.

According to a twenty-first aspect of the present invention, it is possible to form a first boundary between the upper accumulating part and the first sloped wall, and a second boundary between the lower accumulating part and the first sloped wall of the sixteenth aspect of the present invention, in a curved surface, respectively.

Furthermore, it is preferable to form the first boundary between the upper accumulating part and the first sloped wall, and the second boundary between the lower accumulating part and the first sloped wall, in a curved shaped, respectively. The purpose of this is to make the game medium accumulated on the upper accumulating part slidingly fall along the first sloped wall with the minimum resistance, or for the purpose of slidingly moving the game medium accumulated on the lower accumulating part upward along the first sloped wall with the minimum resistance. The preferable curvature of the curved surfaces depends on diameter dimension of the game medium, but any curvature is possible as long as the curvature radius of the curved surfaces is sufficiently larger than diameter dimension of the game medium. It is possible to easily empirically decide the preferable curvature.

Furthermore, as described above, it is preferable to reduce the frictional resistance generated between the first sloped wall and the game medium as much as possible. The following configuration is effective for reducing the frictional resistance.

According to a twenty-second aspect of the present invention, it is possible to configure the first sloped wall of the sixteenth aspect of the present invention to include at least one protrusion that is formed to reduce friction with the game medium slidingly-rolling along the first guide.

As described above, the game medium is formed in an approximately disk shape. Accordingly, when the first sloped wall includes a flat surface, the entire area of the lateral surface of the game medium makes contact with the flat surface of the first sloped wall. Reducing the contact area between the game medium and the first sloped wall effectively works for reducing the frictional force between the game medium and the first sloped wall. In order to reduce the contact area, it is preferable that the first sloped wall includes at least one protrusion that is formed to reduce friction with the game medium slidingly rolling along the first guide. When the lateral surface of the game medium makes contact with at least one protrusion, the contact area between the game medium and the first sloped wall will be reduced.

According to a twenty-third aspect of the present invention, the at least one protrusion of the twenty-second aspect of the present invention may be made up of at least one ridge-shaped protrusion that is separated upwards from the first guide, at distance less than diameter of the game medium and that extends approximately in parallel with a direction in which the first guide is extended. It is important that the contact area between the game medium and the first sloped wall is reduced by the existence of the at least one protrusion, and furthermore, the at least one protrusion does not block the game medium that rolls along the first guide under the influence of gravity. A typical example of the at least one protrusion that meets the above conditions may be formed at least one ridge-shaped protrusion that is separated upward from the first guide at distance less than diameter of the game medium and that extends approximately in parallel with a direction in which the first guide is extended. With the configuration, the game medium rolling along the first guide slidingly makes contact with the at least one ridge-shaped protrusion. Accordingly, the contact area between the game medium and the first sloped wall is reduced, and thus it becomes possible to effectively reduce the frictional force between the game medium and the first sloped wall. The ridge-shaped protrusion(s) may be made up of a single ridge-shaped protrusion or a plurality of ridge-shaped protrusions.

According to a twenty-fourth aspect of the present invention, the at least one protrusion of the twenty-second aspect of the present invention may be formed as a plurality of protrusions scattered above the first guide, instead of the above described at least one ridge-shaped protrusion. It is preferable to set intervals between adjacent protrusions to be sufficiently less than diameter dimension of the game medium. Furthermore, it is preferable to form the plurality of protrusions to be regularly scattered at predetermined intervals. With the configuration, the game medium rolling along the first guide slidingly makes contact with the plurality of scattered protrusions. Accordingly, the contact area between the game medium and the first sloped wall is reduced, and thus it becomes possible to effectively reduce the frictional force to be generated between the game medium and the first sloped wall. From the perspective of reduction of the frictional force, it is preferable to form the plurality of protrusions such that the top thereof is processed in a round shape.

Accordingly, the contact area between the game medium and the first sloped wall is reduced and thus it becomes possible to effectively reduce the frictional force between the game medium and the first sloped wall. From the perspective of reduction of the frictional force, it is preferable to form the plurality of protrusions such that the top thereof is processed in a round shape.

According to a twenty-fifth aspect of the present invention, a first vibration device may be provided, which is configured to apply minute vibration to the first sloped wall of the sixteenth aspect of the present invention.

It is possible to provide a first vibration device that is configured to apply minute vibration to the first sloped wall as another effective technique for reducing the frictional force between the game medium and the first sloped wall. The game medium and the first sloped wall are prevented from closely making contact with each other by applying minute vibration to the first sloped wall. As a result, it becomes possible to reduce the effective contact area between the game medium and the first sloped wall and effectively reduce the frictional resistance. The situation should be avoided where the game medium instably rolls along the first guide when too much vibration is applied to the first sloped wall. In addition, too much vibration is not preferable because it may make a game player uncomfortable. It is possible to form the first vibration device with a conventionally known vibration motor. However, the first vibration device is not necessarily limited to this.

According to a twenty-sixth aspect of the present invention, the first sloped wall of the sixteenth aspect of the present invention may include a plurality of ventilation holes scattered above the first guide, and a first ventilating device may providing the ventilation from the back side of the first sloped wall through the plurality of vent holes.

It is possible to provide a configuration that the first sloped wall includes a plurality of vent holes scattered above the first guide, and a first ventilating device as another effective technique for reducing the frictional force between the game medium and the first sloped wall. Buoyancy for floating the game medium from the first sloped wall is applied to the game medium by ventilation through the plurality of vent holes, and the contact force between the game medium and the first sloped wall is reduced. As a result, the frictional force between the game medium and the first sloped wall is reduced. Here, it is preferable to set intervals between adjacent vent holes to be sufficiently less than the dimension of the game medium in the diameter direction. Furthermore, it is preferable to form the plurality of vent holes to be regularly scattered at predetermined intervals. In addition, the first ventilating device may be embodied as a ventilating fan on the back side of the first sloped wall. With the configuration, the game medium rolls along the first guide while the contact force between the game medium and the first sloped wall is reduced by the buoyancy applied by ventilation through the plurality of scattered vent holes. Therefore, it becomes possible to effectively reduce the frictional resistance to be generated between the game medium and the first sloped wall.

According to a twenty-seventh aspect of the present invention, the first sloped wall of the sixteenth aspect of the present invention may be made up of a reticulated sloped wall. It is possible to provide a configuration that the first sloped wall is made up of a reticulate sloped wall as another effective technique for reducing the frictional force between the game medium and the first sloped wall. Here, it is preferable that reticular grid intervals are set to be sufficiently less than diameter dimension of the game medium. Here, the first sloped wall is made up of a reticular sloped wall. Therefore, the contact area between the game medium and the first sloped wall is reduced, and thus it becomes possible to effectively reduce the frictional resistance to be generated between the game medium and the first sloped wall.

According to a twenty-eighth aspect of the present invention, it is preferable that the first slot of the first shooter of the sixteenth aspect of the present invention is configured to have dimension by which only one game medium is allowed to be inserted therein at one time. The configuration serves to reliably prevent a situation that a plurality of game media are stuck in a guide groove for guiding a game medium. The guide groove is formed to lead to the first slot, when a plurality of game media are simultaneously inserted the first slot.

According to a twenty-ninth aspect of the present invention, it is preferable that at least surface of the first sloped wall of the sixteenth aspect of the present invention is made of self-lubricating material. Only the surface may be formed with the material having the self-lubricating property, or the entirety of the first sloped wall may be formed with the material having the self-lubricating property. Furthermore, in addition to the first sloped wall, the surface or the entirety of the accumulating part may be also made of material having the self-lubricating property. It is possible to take engineering plastic such as Teflon (registered trademark) and oil-impregnated sintered metal (example of commercial product: oilless metal plate) as a typical example of the material having the self-lubricating property. However, the material is not necessarily limited to this.

According to a thirtieth aspect of the present invention, in addition to elements of the sixteenth aspect of the present invention, the game medium shooting mechanism further includes a second lower accumulating part. the second lower accumulating part is positioned on the opposite side from the first lower accumulating part through the upper accumulating part and accumulates the game medium thereon. This embodiment may also include a second sloped wall, which is positioned on the opposite side from the first sloped wall through the upper accumulating part and is interposed between the upper accumulating part and the second lower accumulating part and is continuously sloped downward and extended from the upper accumulating part to the second lower accumulating part, a second shooter, which includes a second slot in which the game medium is inserted on a position continuously leading to the second sloped wall, and a second guide, which is entirely sloped down and extended to the second slot and is formed on at least a part of the second sloped wall for making the game medium slidingly roll into the second slot under the influence of gravity.

Here, it is only necessary for the second guide to be configured to allow the game medium to slidingly roll into the second slot under the influence of gravity. In order to achieve the purpose, the second guide is configured to include a sloped portion that is sloped down to the second slot on at least a part thereof, and is configured to be entirely sloped down to the second slot. In short, being "entirely sloped down" means that the second guide is configured to include a sloped portion that is sloped toward the second slot on at least a part thereof, and is configured to allow the game medium to slidingly roll into the second slot under the influence of gravity. It is only necessary for the potential energy of the game medium that is located in a position of the second guide to be entirely greater than that of the game medium that is located in a position of the second slot. For example, even if a rising portion is formed in the intermediate portion of the second guide, when the kinetic energy of the game medium is greater than the sum of the potential energy and the frictional energy of the rising portion, the game medium climbs the rising portion with the momentum of the rotational movement performed so far and then rolls into the second slot. In addition, when a rising portion is formed in the intermediate portion of the second guide and the kinetic energy of the game medium is less than the sum of the potential energy and the frictional energy of the rising portion, this does not matter so long as the game medium is capable of climbing the rising portion and then rolling into the second slot by being pushed by another game medium rotationally moving from behind. The second guide may be sloped down and extended to the second slot in a linear, curvilinear, or stepwise shape.

A configuration that a sloped wall is formed only on one side of the upper accumulating part may be provided for allowing the game medium to be shot to the upper accumulating part only from one direction. In addition, a configuration that sloped walls are formed on the both sides of the upper accumulating part may be provided for allowing the game medium to be shot to the upper accumulating part from the both directions. For the purpose of allowing the game medium to be shot from the both directions, it is preferable that the game medium shooting mechanism further includes a second lower accumulating part that is positioned on the opposite side from the first lower accumulating part through the upper accumulating part and accumulates the game medium thereon, a second sloped wall that is positioned on the opposite side from the first sloped wall through the upper accumulating part and is interposed between the upper accumulating part and the second lower accumulating part and is continuously sloped down and extended to the second lower accumulating part from the upper accumulating part, a second shooter that has a second slot in which the game medium is inserted on a position adjacent to the second sloped wall, and a second guide that is extended on the second sloped wall for making the game medium slidingly roll into the second slot under the influence of gravity. The second sloped wall may be formed to have a structure that is the same as that of the above described first sloped wall, or may be formed to have a structure that is different from that of the above described first sloped wall. The structures of the first and second sloped wall include all the matters regarding the above described structure including the shooter and the guide.

Furthermore, according to another aspect of the present invention, a game device including the above described game medium shooting mechanism is provided. It various embodiments the approximately disk-shaped medium may be a medallion. However, it is not necessarily limited to the configuration. It is possible to take a pusher game as a typical example of a medal game device including a medal shooting mechanism. However, it is not necessarily limited to the configuration. According to the above described present invention, even when a game player continuously shoots a medal for a long time, it is possible to largely reduce game player's tiredness. In addition, a game player's nerves are maintained such that the game player is capable of concentrating on the game itself and really enjoying the game.

BEST MODE FOR CARRYING OUT THE INVENTION (1) First Embodiment

As described above, a medal is exemplified as the above described approximately disk-shaped game medium, and a medal shooting mechanism for shooting a medal will be hereinafter specifically disclosed. The medal shooting mechanism may also be applied to a variety of existing medal games. A case where a medal shooting mechanism is applied to a game device including a pusher-type game device as a part of elements will be hereinafter illustrated and explained. First, prior to explanation of a game medium shooting mechanism of a first embodiment of the present invention, summary of a game device to which the shooting mechanism is applied will be hereinafter shortly explained.

Figure 1:
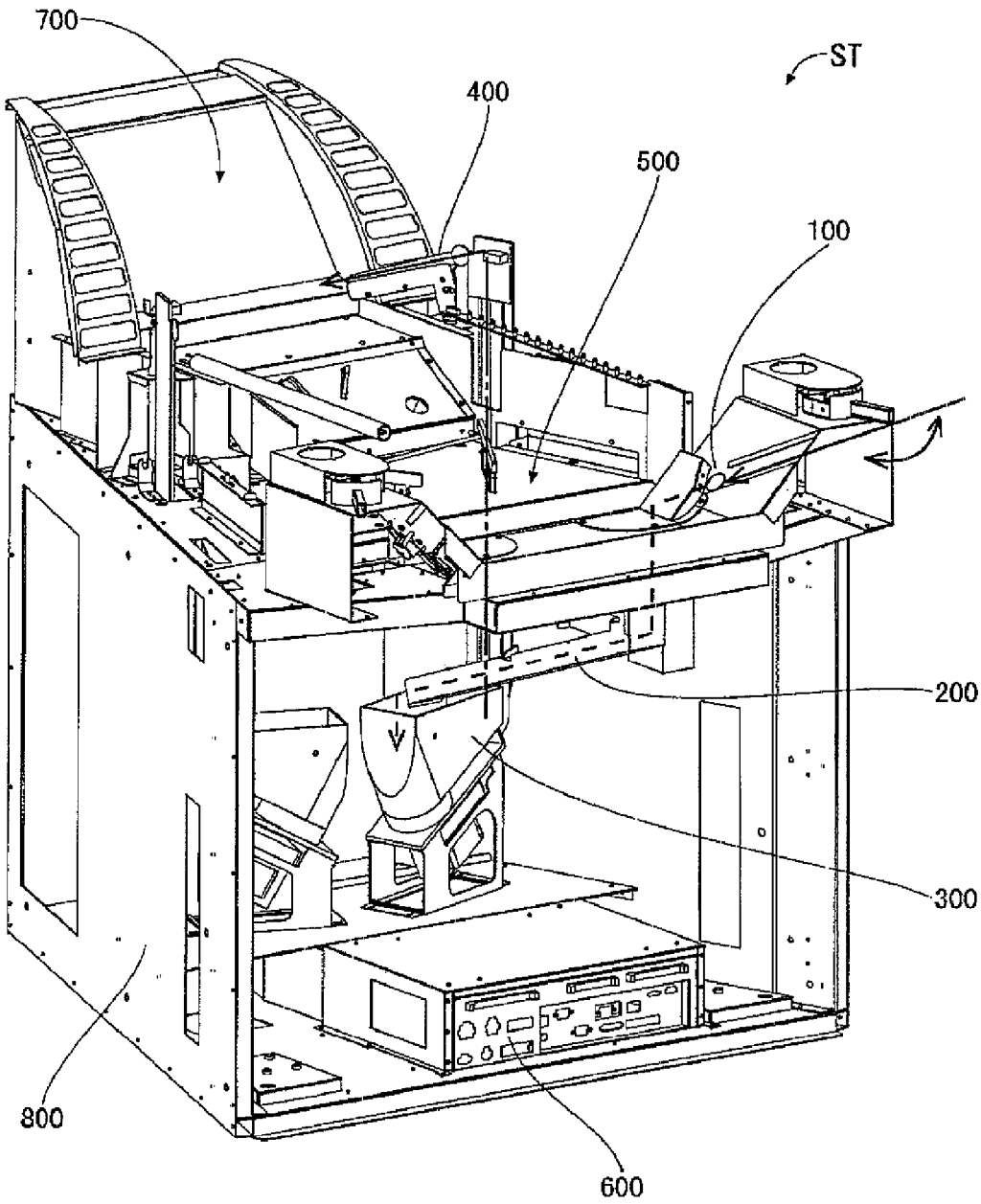
FIG. 1 is a partial perspective view illustrating a part of a station of a game device to which a medal shooting mechanism of the present invention may be applied.

FIG. 1 is a partial perspective view illustrating a part of a station of a game device to which a medal shooting mechanism of the present invention may be applied. As illustrated in FIG. 1, a station ST of the game device is configured to include a medal shooting mechanism 100, a medal transporting path 200, a lifting-up hopper 300, a medal discharging path 400, a playing field 500, a control unit 600, a display unit 700, and a chassis 800. The medal shooting mechanism 100 is disposed in the upper front side of the chassis 800. Here, the term "front side" means a side on which a game player stands when the player plays a game. The medal transporting path 200 and the lifting-up hopper 300 are disposed in the interior of the chassis 800. The medal shooting mechanism 100 and the lifting-up hopper 300 are mechanically and physically coupled through the medal transporting path 200, and the medal transporting path 200 has a function of transporting a medal shot from the medal shooting mechanism 100 to the lifting-up hopper 300.

The playing field 500 is formed on the top surface of the chassis 800. The medal discharging path 400 is disposed on the upper side portion of the chassis 800. A discharging end of the medal discharging path 400 is located on a space above the playing field 500. A supplying end of the medal discharging path 400 is located above the lifting-up hopper 300. A medal is lifted up to the supplying end of the medal discharging path 400 by the lifting-up hopper 300, and then it is supplied on the playing field 500 from the discharging end through the medal discharging path 400.

The control unit 600 is disposed in the interior of the chassis 800. Display unit 700 is disposed on the upper rear side of the chassis 800. Here, the term "rear side" means an opposite side from the above described "front side." A game player is capable of recognizing a state of a medal on the playing field 500 by directly watching the playing field 500. Note that the station ST is controlled by the control unit 600, and information that should be displayed for a player is displayed on the display unit 700. As described above, the present invention relates to the medal shooting mechanism 100. Therefore, the configuration and effects thereof will be hereinafter focused and explained in detail.

Figure 2:
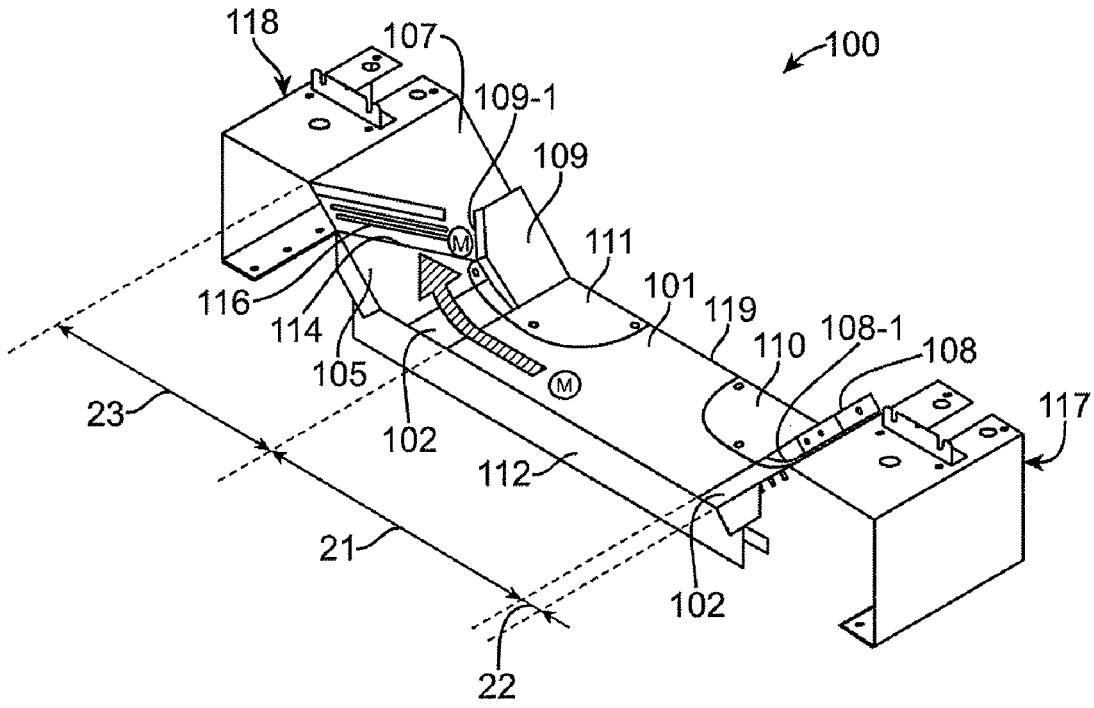
FIG. 2 is a perspective view illustrating a medal shooting mechanism in accordance with a first embodiment of the present invention.
Figure 3:
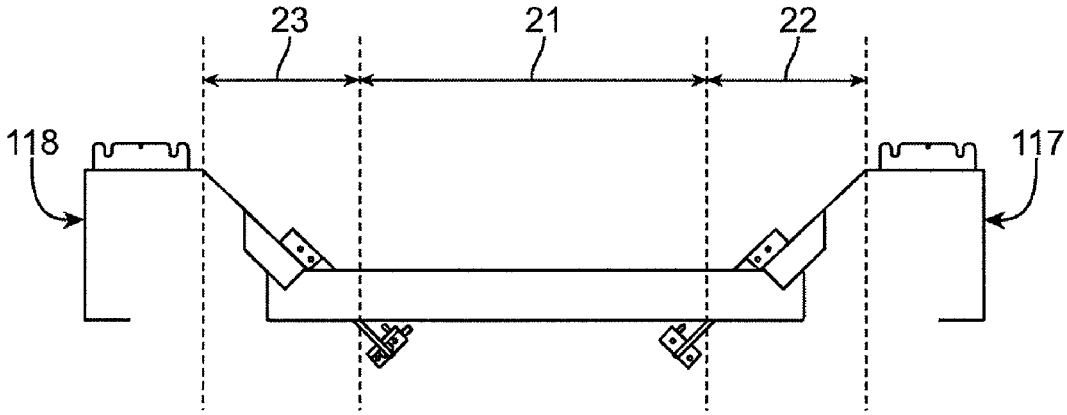
FIG. 3 is a front view of the medal shooting mechanism illustrated in FIG. 2.
Figure 4:
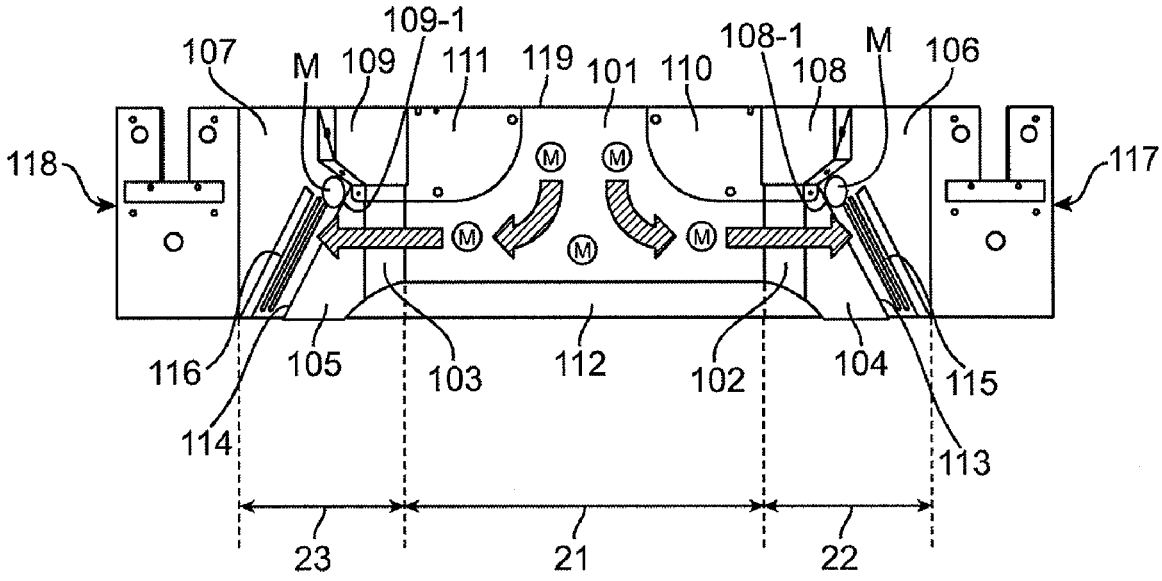
FIG. 4 is a top view of the medal shooting mechanism illustrated in FIG. 2.
Figure 5:
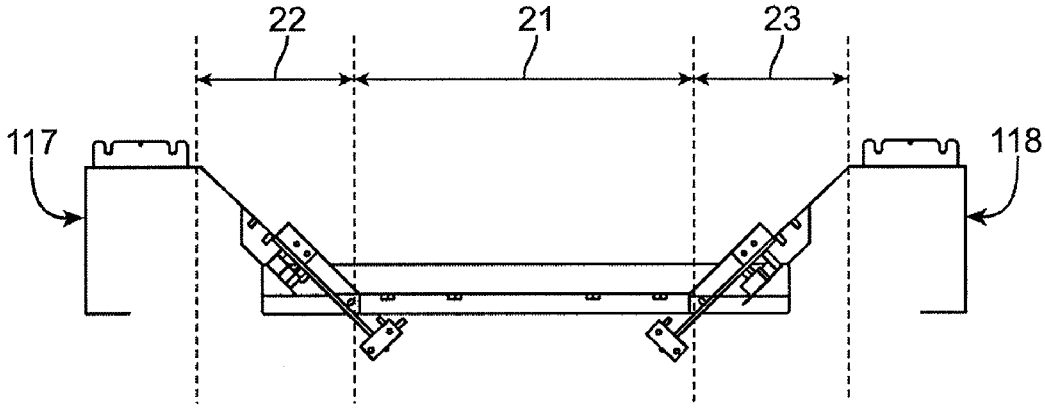
FIG. 5 is a back view of the medal shooting mechanism illustrated in FIG. 2.

FIG. 2 is a perspective view illustrating the medal shooting mechanism of the first embodiment of the present invention. FIG. 3 is a front view of the medal shooting mechanism illustrated in FIG. 2. FIG. 4 is a top view of the medal shooting mechanism illustrated in FIG. 2. FIG. 5 is a back view of the medal shooting mechanism illustrated in FIG. 2.

The medal shooting mechanism 100 includes a flat area 21, a first sloped area 22 and a second sloped area 23 that are located on the both sides of the flat area 21, a first lateral structure 117 that is located external to the first sloped area 22, and a second lateral structure 118 that is located external to the second sloped area 23. The medal shooting mechanism 100 includes an accumulating part 101 on which a plurality of medals are accumulated. The accumulating part 101 makes up the flat area 21 of the medal shooting mechanism 100.

The medal shooting mechanism 100 further includes a first sloped wall that is continuously sloped up and extended from a first boundary area 102 adjacent to a first lateral portion of the accumulating part 101. The first sloped wall makes up the first sloped area 22. The first sloped wall is formed by the first sloped wall lower area 104 and the first sloped wall upper area 106. The first boundary area 102 is formed by a curved surface.

The medal shooting mechanism 100 further includes a second sloped wall that is continuously sloped up and extended from a second boundary area 103 adjacent to a second lateral portion of the accumulating part 101, which is located on the opposite side from the above described first lateral portion. The second sloped wall makes up the second sloped area 23. The second sloped wall is formed by the second sloped wall lower area 105 and the second sloped wall upper area 107. The second boundary area 103 is formed by a curved surface.

The medal shooting mechanism 100 further includes a first medal shooter 108 that includes a first medal slot 108-1 on a position adjacent to the first sloped wall, and a second medal shooter 109 that includes a second medal slot 109-1 on a position adjacent to the second sloped wall. The first boundary area 102, the first sloped wall lower area 104, the first sloped wall upper area 106, and the first medal shooter 108 make up the first sloped area 22 of the medal shooting mechanism 100. The second boundary area 103, the second sloped wall lower area 105, the second sloped wall upper area 107, and the second medal shooter 109 make up the second sloped area 23 of the medal shooting mechanism 100.

The first medal shooter 108 further includes a first attached flange 110. The first attached flange 110 is extended from a part of the first boundary area 102 to a part of the accumulating part 101. The second medal shooter 109 further includes a second attached flange 111. The second attached flange 111 is extended from a part of the second boundary area 103 to a part of the accumulating part 101. As illustrated in FIG. 4, the first attached flange 110 and the second attached flange 111 that are extended on the accumulating part 101 respectively have a largely-rounded corner. The first attached flange 110 and the second attached flange 111 delimit a medal accumulating area on which a medal M is accumulated on the accumulating part 101. The first attached flange 110 and the second attached flange 111 are separately disposed from each other, and the medal M is supplied from a medal supplying side 119 between the two flanges 110 and 111. Movement of the supplied medal M is restricted by the largely-rounded corners of the first attached flange 110 and the second attached flange 111. A first medal constraining plate 112 prevents the medal M from falling from the accumulating part 101 to the front side on which a player stands, and is disposed on an opposite lateral side from the medal supplying side 119 of the accumulating part 101.

A first guide 113 is formed on the boundary between the first sloped wall lower area 104 and the first sloped wall upper area 106. The first guide 113 is configured to catch the medal slidingly falling along the first sloped wall upper area 106 and is also configured to make the medal slidingly roll into the first medal slot 108-1 along the first guide. The first guide 113 is formed by a first step 113 formed on the boundary between the first sloped wall lower area 104 and the first sloped wall upper area 106. The first step 113 is linearly sloped down and extended to the first medal slot 108-1. The first sloped wall upper area 106 includes at least one protrusion that is formed to reduce friction to be generated between the first sloped wall upper area 106 and the medal M slidingly rolling along the first guide 113. In other words, the first sloped wall upper area 106 includes at least one ridge-shaped protrusion 115 that is separated upward from the first guide 113 at distance less than diameter of the medal M and is extended approximately in parallel with a direction in which the first guide 113 is extended. Specifically, a plurality of ridge-shaped protrusions 115 are formed as illustrated in the figure.

A second guide 114 is formed on the boundary between the second sloped wall lower area 105 and the second sloped wall upper area 107. The second guide 114 is configured to catch the medal slidingly falling along the second sloped wall upper area 107 and is also configured to make the medal slidingly roll into the second medal slot 109-1 along the second guide. The second guide 114 is formed by a second step 114 formed on the boundary between the second sloped wall lower area 105 and the second sloped wall upper area 107. The second step 114 is linearly sloped down and extended to the second medal slot 109-1. The second sloped wall upper area 107 includes at least one protrusion that is formed to reduce friction to be generated between the second sloped wall upper are 135 and the medal M slidingly rolling along the second guide 114. In other words, the second sloped wall upper area 107 includes at least one ridge-shaped protrusion 116 that is separated upward from the second guide 114 at distance less than diameter of the medal M and is extended approximately in parallel with a direction in which the second guide 114 is extended. Specifically, a plurality of ridge-shaped protrusions 116 are formed as illustrated in the figure.

The external upper end of the first sloped wall upper area 106 is combined with the first lateral structure 117. The first lateral structure 117 is formed to have a deformed L-shaped cross section, and includes a flat top, a perpendicular wall, and a flat bottom. The flat top is continuously extended outward from the external upper end of the first sloped wall upper area 106. The perpendicular wall is perpendicularly extended downward from the external end of the flat top. The flat bottom is inwardly extended from the bottom end of the perpendicular wall. An operating handle of a control system for controlling a position and a direction of a discharging end of the medal discharging path 400 is attached to the flat top. A player controls the position and the direction of the discharging end of the medal discharging path 400 by manipulating the operating handle. The flat bottom serves as an attached flange for attaching the medal shooting mechanism 100 to the chassis 800 of the station ST.

The external upper end of the second sloped wall upper area 107 is combined with the second lateral structure 118. The second lateral structure 118 is formed to have a deformed L-shaped cross section, and includes a flat top, a perpendicular wall, and a flat bottom. The flat top is continuously extended outward from the external upper end of the second sloped wall upper area 107. The perpendicular wall is perpendicularly extended downward from the external end of the flat top. The flat bottom is inwardly extended from the bottom end of the perpendicular wall. An operating handle of a control system for controlling a position and a direction of a discharging end of the medal discharging path 400 is attached to the flat top. A player controls the position and the direction of the discharging end of the medal discharging path 400 by manipulating the operating handle. The flat bottom serves as an attached flange for attaching the medal shooting mechanism 100 to the chassis 800 of the station ST.

When the accumulating part 101, the first boundary area 102, the second boundary area 103, the first sloped wall lower area 104, the second sloped wall lower area 105, the first sloped wall upper area 106, and the second sloped wall upper area 107 are formed in one member, seams are not formed in the area on which the medal M is movable. Accordingly, it becomes possible to reduce the resistance.

Also, the first medal slot 108-1 of the first medal shooter 108 and the second medal slot 109-1 of the second medal shooter 109 have dimensions that only one medal M is allowed to be inserted thereunto at a time. The configuration serves to reliably prevent a situation that a plurality of medals M are stuck in the first medal shooter 108 or the second medal shooter 109 when the medals M are simultaneously inserted into the first medal slot 108-1 or the second medal slot 109-1.

The above described medal shooting mechanism 100 has an approximately symmetrical shape and structure with reference to the middle position between the first and second lateral portions.

Figure 6:
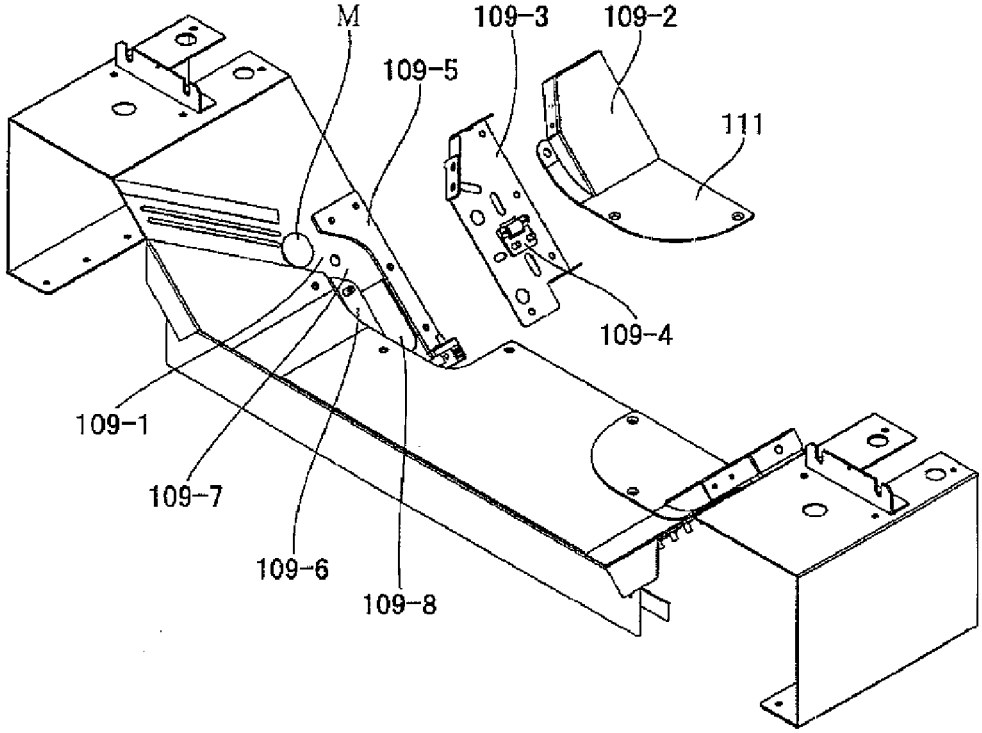
FIG. 6 is a partial exploded view of the medal shooting mechanism illustrated in FIG. 2.

FIG. 6 is a partial exploded view of the medal shooting mechanism illustrated in FIG. 2. The first medal shooter 108 and the second medal shooter 109 are formed in the same structure. Therefore, the internal structure of the second medal shooter 109 will be hereinafter explained with reference to FIG. 6.

The second medal shooter 109 includes a second medal slot 109-1 adjacent to the second guide 114, that is, an abutment portion of the second guide 114, a medal shooting path 109-7 in communication with the abutment portion of the second guide 114, a medal falling hole 109-8 in communication with the medal shooting path 109-7, and a first medal guide plate 109-5 and a second medal guide plate 109-6, both of which delimit the medal shooting path 109-7 and the both lateral portions of the medal falling hole 109-8. The medal shooting path 109-7 is formed to guide the medal M that is shot through the second medal slot 109-1 to the medal falling hole 109-8.

Furthermore, the second medal slot 109 includes a first intermediate plate 109-3 having a first roller 109-4. The first intermediate plate 109-3 is attached to the first metal guide plate 109-5 and the second medal guide plate 109-6. The first roller 109-4 is positioned on the medal falling hole 109-8. Therefore, when the medal M passing through the medal shooting path 109-7 heads to a position on the medal falling hole 109-8, the medal M comes into contact with the first roller 109-4 and is slightly pressed down, and thus it falls through the medal falling hole 109-8. The fallen medal M is transported to the lifting-up hopper 300 through the medal transporting path 200 illustrated in FIG. 1. Then, the medal M is lifted up to the supplying end of the medal discharging path 400 by the lifting-up hopper 300, and is supplied on the playing field 500 from the discharging end through the medal discharging path 400. Furthermore, the second medal slot 109 includes a first medal shooter cover 109-2. The first medal shooter cover 109-2 covers the first intermediate plate 109-3. In addition, the first medal shooter cover 109-2 is integrally formed with the second attached flange 111. When the second attached flange 111 is fixed to the accumulating part 101, the first medal shooter cover 109-2 is indirectly fixed to a position on the intermediate plate 109-3 is indirectly fixed.

When a game player slides the medal M accumulated on the accumulating part 101 upward along the first sloped wall lower area 104 and the first sloped wall upper area 106, and the second sloped wall lower area 105 and the second sloped wall upper area 107, all of which are continuously sloped up and extended from the accumulating part 101, and then releases the medal M, the medal M slidingly falls along the first sloped wall upper area 106 and the second sloped wall upper area 107 under the influence of gravity and is caught by the first step 113 forming the first guide 113 and the second step 114 forming the second guide 114. Also, the first step 113 and the second step 114 are configured to make the medal M slidingly roll into the first medal slot 108-1 and the second medal slot 109-1 under the influence of gravity.

In other words, if a game player slides the medal M upward along the first sloped wall lower area 104 and the first sloped wall upper area 106, and the second sloped wall lower area 105 and the second sloped wall upper area 107, all of which are continuously sloped up and extended from the accumulating part 101, and then releases the medal M, the medal M slidingly falls along the first sloped wall upper area 106 and the second sloped wall upper area 107 under the influence of gravity and is caught by the first step 113 and the second step 114. Then, the medal M slidingly rolls into the first medal slot 108-1 of the first shooter and the second medal slot 109-1 along the first step 113 and the second step 114 under the influence of gravity. When the medal M rolls along the first step 113 and the second step 114, the medal M is going to slide with respect to the first sloped wall upper area 106 and the second sloped wall upper area 107. In other words, it is only necessary for a game player to slide the medal M upward from the accumulating part 101 along the first sloped wall lower area 104 and the first sloped wall upper area 106, and the second sloped wall lower area 105 and the second sloped wall upper area 107, and then release the medal M. Therefore, it is not required for a game player to manually carry the medal M from the accumulating part 101 to the first medal slot 108-1 and the second medal slot 109-1 as is conventionally performed. In other words, this makes a game player comfortably move one's hand by making use of the influence of gravity.

Accordingly, even when a game player continuously shoots medals M for a long time, it is possible to largely reduce game player's tiredness. In addition, a game player does not wear out ones nerves too much for shooting the medal M, and thus the game player is capable of concentrating on the game itself and really enjoying the game.

Also, if a game player slides the medal M upward along the first sloped wall lower area 104 and the first sloped wall upper area 106, and the second sloped wall lower area 105 and the second sloped wall upper area 107 and then releases the medal M, the medal M slidingly falls along the first sloped wall upper area 106 and the second sloped wall upper area 107 under the influence of gravity and is caught by the first step 113 and the second step 114. Then, the medal M slidingly rolls into the first medal slot 108-1 of the first shooter and the second medal slot 109-1 along the first step 113 and the second step 114 under the influence of gravity. In other words, it becomes possible to largely reduce game player's tiredness even when the game player continuously shoots the medal M for a long time without automating shooting of the medal M. Accordingly, it becomes possible to really fascinate a game player for a long time while the game player feels that the game player oneself actively plays the game.

It is only necessary for the first step 113 and the second step 114 to have a function of catching the medal M that slidingly falls along the first sloped wall upper area 106 and the second sloped wall upper area 107 under the influence of gravity, and a function of making the medal M slidingly roll into the first medal slot 108-1 and the second medal slot 109-1 along the first step 113 and the second step 114 under the influence of gravity. However, it is required to slidingly move the medal M to a position higher than the first guide 113 (i.e., the first step 113) and the second guide 114 (i.e., the second step 114). Therefore, when the medal M is slidingly moved upward, it is preferable that the first guide 113 (i.e., the first step 113) and the second guide 114 (i.e., the second step 114) does not block movement of the medal M. In consideration of this, it is meaningful that the first guide 113 is formed by the first step 113 and the second guide 114 is formed by the second step 114. Note that an important point is that the step surfaces of the first and second steps 113 and 114 face upward. With the configuration, it becomes easy to slidingly move the medal M upward across the first step 113 and the second step 114. In addition, it becomes possible to catch the medal M on the step surfaces of the first step 113 and the second step 114, when the medal M once slidingly moved upward is released from a hand of a game player and slidingly falls along the first sloped wall upper area 106 and the second sloped wall upper area 107. When the step surfaces of the first step 113 and the second step 114 face downward, it is impossible to block the medal M that slidingly moves upward along the first sloped wall lower area 104 and the first sloped wall upper areas 106, and the second sloped wall lower area 105 and the second sloped wall upper area 107, and it is also impossible to make the medal M slidingly roll into the first medal slot 108-1 and the second medal slot 109-1 under the influence of gravity while the medal M is caught.

It is possible to achieve the first step 113 by configuring the first sloped wall lower area 104 to have thickness greater than that of the first sloped wall upper area 106. In addition, it is possible to achieve the second step 114 by forming the second sloped wall lower area 105 to have thickness greater than the second sloped wall upper area 107. For example, the first sloped wall and the second sloped wall may be formed by combining a first flat plate that is extended in both of the upper and lower areas and a second flat plate that is extended only in the lower area. In addition, the first sloped wall and the second sloped wall may be formed such that only the lower area of the first flat plate that is extended in both of the upper and lower areas is thinly processed. In both cases, it is possible to achieve the first step 113 and the second step 114 with an existing technique.

Also, it is possible to configure the first step 113 and the second step 114 to be extended to the first medal slot 108-1 and the second medal slot 109-1. In this case, it is required to make the medal M caught by the first step 113 and the second step 114 roll toward the first medal slot 108-1 and the second medal slot 109-1 under the influence of gravity. Accordingly, the first step 113 and the second step 114 are sloped down and extended to the first medal slot 108-1 and the second medal slot 109-1. Specifically, the first step 113 and the second step 114 are formed to be linearly sloped down to the first medal slot 108-1 and the second medal slot 109-1. However, as a modified example, it is possible to form the first step 113 and the second step 114 to be curvilinearly sloped down to the first medal slot 108-1 and the second medal slot 109-1. Furthermore, it is also possible to form the first step 113 and the second step 114 by the combination of linear and curvilinear shapes. However, regardless of a position in the first step 113 and the second step 114 where the medal M is caught, the first step 113 and the second step 114, respectively, have the minimum-required slope angle for making the medal M roll toward the first medal slot 108-1 and the second medal slot 109-1 under the influence of gravity.

Furthermore, it is required to form the abutment portions of the first step 113 and the second step 114 for making the medal M slidingly roll into the first medal slot 108-1 and the second medal slot 109-1 under the influence of gravity. The abutment portions of the first step 113 and the second step 114 are disposed adjacent to the first medal slot 108-1 and the second medal slot 109-1. It is possible to provide a modified example that the abutment portions of the first step 113 and the second step 114 are not disposed to be adjacent to the first medal slot 108-1 and the second medal slot 109-1, that is, gaps are generated between the first step 113 and the first medal slot 108-1, and between the second step 114 and the second medal slot 109-1. However, this is not a matter as long as the medal M rolling the first step 113 and the second step 114 finally rolls into the first medal slot 108-1 and the second medal slot 109-1. For this purpose, the first medal slot 108-1 of the first shooter 108 and the second medal slot 109-1 of the second shooter 109 are disposed adjacent to the first sloped wall and the second sloped wall.

In addition, width of the step surfaces of the first step 113 and the second step 114, in other words, dimensions of the first step 113 and the second step 114 are determined such that the step surfaces of the first step 113 and the second step 114 are capable of catch the medal M that slidingly falls along the first sloped wall upper area 106 and the second sloped wall upper area 107. The minimum-required dimension of the first step 113 and the second step 114 depend on slope angles of the first sloped wall and the second sloped wall and the thickness of the medal M. For example, when the first sloped wall and the second sloped wall are formed to have large slope angles, the step surfaces of the first step 113 and the second step 114 are supposed to be formed to have widths greater than those of a case that the first sloped wall and the second sloped wall are formed to have small slope angles.

Furthermore, when widths of the step surfaces of the first step 113 and the second step 114 are formed to be much less than thickness of the medal M, it is impossible to catch the medal M that slidingly falls along the first sloped wall upper area 106 and the second sloped wall upper area 107, and thus the medal M slidingly falls to the accumulating part 101 across the first step 113 and the second step 114. As a result, it is impossible to insert the medal M into the first medal slot 108-1 and the second medal slot 109-1. Therefore, in consideration of thickness of the medal M and the slope angles of the first sloped wall and the second sloped wall, it is required for the step surfaces of the first step 113 and the second step 114 to have the minimum-required widths for catching the medal-M that slidingly falls along the first sloped wall upper area 106 and the second sloped wall upper area 107. When the step surfaces of the first step 113 and the second step 114 are formed to have widths greater than thickness of the medal M, it is possible to increase the likelihood of catching the medal M that slidingly falls along the first sloped wall upper area 106 and the second sloped wall upper area 107. In addition, when the step surfaces of the first step 113 and the second step 114 are formed to have greater than twice the thickness of the medal M, it becomes possible to simultaneously catch two overlapping medals M that slidingly fall along the first sloped wall upper area 106 and the second sloped wall upper area 107. It should be note that when widths of the step surfaces of the first step 113 and the second step 114 are formed to be too large, the medal M may flop on the first step 113 and the second step 114 while the medal M is slidingly moved upward across the first step 113 and the second step 114, and thus there is a possibility that the medal M does not smoothly roll across the first step 113 and the second step 114.

Figure 21:
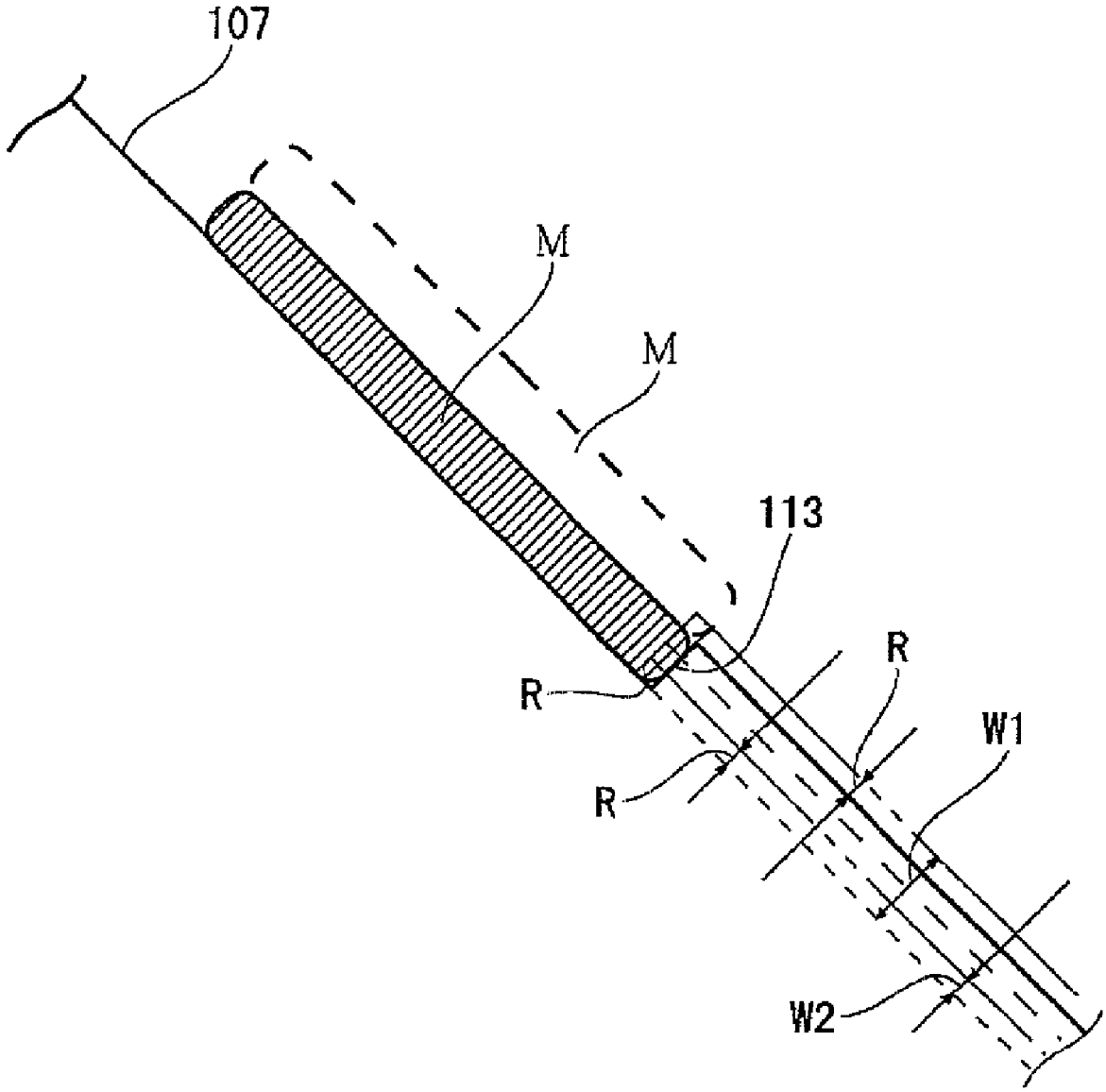
FIG. 21 is a diagram for explaining relation between thickness of a medal and width of step surfaces of the first and second steps.

FIG. 21 is a diagram for illustrating a relation between thickness of the medal M and widths of the step surfaces of the first step 113 and the second step 114. In a case that the peripheral portion of the medal M is formed to have a non-rectangular cross-section so that the corners of the cross-section are formed to have rounds R, the medal M may be caught by the first step 113 and the second step 114 when the step surfaces of the first step 113 and the second step 114 are formed to have widths W2 greater than or equal to thickness R of the round shaped portions. However, in a practical situation, the medal M that slidingly falls along the first sloped wall upper area 106 and the second sloped wall upper area 107 may not be caught by the first step 113 and the second step 114 as a result of impact and/or vibration to be generated when the medal M makes contact with the first step 113 and the second step 114. Therefore, the step surfaces of the first step 113 and the second step 114 are designed to have widths greater than the theoretically minimum-required width W2. Furthermore, as illustrated in FIG. 21, for the purpose of simultaneously catching the two overlapping medals M that slidingly fall along the first sloped wall upper area 106 and the second sloped wall upper area 107, the two overlapping medals M may be theoretically caught when the step surfaces of the first step 113 and the second step 114 are formed to have widths W1 greater than or equal to the sum of thickness of the single medal M and thickness R of the round shaped portion. However, in a practical situation, impact and/or vibration are/is generated when two overlapping medals M slidingly fall along the first sloped wall upper area 106 and the second sloped wall upper area 107 and make contact with the first step 113 and the second step 114. Accordingly, one of the two medals M, which is overlapped on the other, may not be caught by the first step 113 and the second step 1114. Therefore, for the purpose of catching both of the two overlapping medals M, the step surfaces of the first step 113 and the second step 114 are designed to have widths greater than the theoretically minimum-required width W1.

From the perspective, in order to catch the single medal M, it is preferable to design the step surface of the first step to have width approximately corresponding to thickness of the single game medium. Here, "approximately" corresponding to thickness of the single game medium means that the width includes error corresponding to the thickness R of the round shaped portion.

Furthermore, angle of the step surface of the first step is preferably right angle or acute angle with respect to the first sloped wall. When the angle of the step surface of the first step is set to be obtuse angle with respect to the first sloped wall, there is a high possibility that the game medium that slidingly falls along the first sloped wall slidingly falls without being caught by the first step.

When the first sloped wall and the second sloped wall are formed to have large slope angles, in other words, when the first sloped wall lower area 104 and the first sloped wall upper area 106, and the second sloped wall lower area 105 and the second sloped wall upper areas 107, are formed to be nearly perpendicular, it becomes difficult to slidingly move the medal M upward from the accumulating part 101 to the sloped wall lower area 104 and the first sloped wall upper area 106, and the second sloped wall lower area 105 and the second sloped wall upper area 107. On the other hand, when the first sloped wall and the second sloped wall are formed to have small slope angles, in other words, when the first sloped wall lower area 104 and the first sloped wall upper area 106, and the second sloped wall lower area 105 and the second sloped wall upper area 105 are set to be nearly flat, it becomes easy to slidingly move the medal M upward from the accumulating part 101 to the first sloped wall lower area 104 and the first sloped wall upper area 106, and the second sloped wall lower area 105 and the second sloped wall upper area 107. However, after a game player releases the medal M, the frictional force between the medal M and the first and second sloped walls will be increased. Therefore, the medal M becomes less easily slidingly falls along the first sloped wall upper area 106 and the second sloped wall upper area 107. In addition, the frictional force will be large, which is generated when the medal M slidingly moves on the first sloped wall upper area 106 and the second sloped wall upper area 107 while rolling along the first step 113 and the second step 114. Accordingly, there is a possibility that the medal M stops moving on the way to the first medal slot 108-1 and the second medal slot 109-1 and thus cannot reach the first medal slot 108-1 and the second medal slot 109-1. Therefore, in consideration of the above, it is required for the first sloped wall lower area 104 and the first sloped wall upper area 106, and the second sloped wall lower area 105 and the second sloped wall upper area 107 to have slope angle that is neither nearly perpendicular nor nearly flat. For example, it is preferable to set the first sloped wall lower area 104 and the first sloped wall upper area 106, and the second sloped wall lower area 105 and the second sloped wall upper area 107 to have the slope angle of 20-70 degrees. Furthermore, it is more preferable to set them to have the slope angle of 30-60 degrees. The first sloped wall lower area 104 and the first sloped wall upper area 106, and the second sloped wall lower area 105 and the second sloped wall upper area 107 may be typically set to have the slope angles of approximately 45 degrees.

Furthermore, for the purpose of slidingly moving the medal M upward from the accumulating part 101 to the first sloped wall lower area 104 and the second sloped wall lower area 105 with the minimum resistance, it is preferable to form the first boundary area 102 and the second boundary area 103 to be curved surfaces. The preferable curvature of the curved surfaces depends on diameter dimension of the medal M, but it is only necessary for the curved surfaces to have curvature radius sufficiently greater than diameter dimension of the medal M. It is possible to easily empirically decide the preferable curvature.

Furthermore, as described above, it is preferable to reduce the frictional resistance to be generated between the first and second sloped walls and the medal M as much as possible. A plurality of first ridge-shaped protrusions 115 and a plurality of second ridge-shaped protrusion 116 effectively work for reducing the frictional force. The medal M is formed in an approximately disk shape. Furthermore, when the first sloped wall upper area 106 and the second sloped wall upper area 107 are formed to have flat surfaces, the entire area of the lateral surface of the medal M makes contact with the flat surfaces of the first sloped wall upper area 106 and the second sloped wall upper area 107. Reducing the contact area between the medal M and the first sloped wall upper area 106 and the second sloped wall upper area 107 effectively works for reducing the frictional force between the medal M and the first sloped wall upper area 106 and the second sloped wall upper area 107. In order to reduce the contact area, the plurality of first ridge-shaped protrusions 115 and the plurality of second ridge-shaped protrusions 116 are formed in the first sloped wall upper area 106 and the second sloped wall upper area 107. With the configuration, the medal M that rolls on the first guide 113 (i.e., the first step 113) and the second guide 114 (i.e., the second step 114) slidingly makes contact with the plurality of first ridge-shaped protrusions 115 and the plurality of second ridge-shaped protrusions 116. Accordingly, the contact area between the medal M and the first sloped wall upper area 106 and the second sloped wall upper area 107 is reduced, and thus it is possible to effectively reduce the frictional force.

In order to reduce the frictional force, it is preferable to form at least the surfaces of the first sloped wall upper area 106 and the second sloped wall upper area 107 with material having self-lubricating property. Only the surfaces may be formed with the material having the self-lubricating property, or the entirety of the first sloped wall upper area 106 and the second sloped wall upper area 107 may be formed with the material having the self-lubricating property. Furthermore, in addition to the first sloped wall upper area 106 and the second sloped wall upper area 107, the surfaces of or the entirety of the first sloped wall lower area 104, the second sloped wall lower area 105, the first boundary area 102, the second boundary area 103, and the accumulating part 101 may be formed with the material having the self-lubricating property. It is possible to take engineering plastic such as Teflon (registered trademark) and oil-impregnated sintered metal (example of commercial product: oilless metal plate) as a typical example of the material having the self-lubricating property. However, the material is not necessarily limited to this. Instead of forming at least the surfaces of the first sloped wall upper area 106 and the second sloped wall upper area 107 with the material having the self-lubricating property, it is possible to remove the plurality of first ridge-shaped protrusions 115 and the plurality of second ridge-shaped protrusions 116, both of which are provided for reducing the frictional resistance.

As described above, the medal shooting mechanism 100 of the present embodiment includes the first sloped wall that is continuously sloped up and extended from the first boundary area 102 adjacent to the first lateral portion of the accumulating part 101. The first sloped wall makes up the first sloped area 22. The first sloped wall is formed by the first sloped wall lower area 104 and the first sloped wall upper area 106. The medal shooting mechanism 100 further includes the second sloped wall that is continuously sloped up and extended from the second boundary area 103 adjacent to the second lateral portion of the accumulating part 101, which is located on the opposite side from the above described first lateral portion. The second sloped wall makes up the second sloped area 23. The second sloped wall is formed by the second sloped wall lower area 105 and the second sloped wall upper area 107. It is only necessary for the first sloped wall and the second sloped wall to be formed for allowing the game medium to slidingly move upward and slidingly fall along the first sloped wall and the second sloped wall. Therefore, it is not necessarily required for the first sloped wall and the second sloped wall, respectively, to be formed by a sloped plane with predetermined slope angle. For example, the first sloped wall and the second sloped wall may be formed by a sloped-curved surface with non-uniform slope angle, respectively.

As described above, the guides for making the medal functioning as the game medium slidingly roll into the first medal slot 108-1 and the second medal slot 109-1 are formed by the first step 113 and the second step 114 that are respectively sloped down and extended to the first medal slot 108-1 and the second medal slot 109-1. However, it is not necessarily required for the first step 113 and the second step 114 to be formed linearly sloped down and extended for the purpose of allowing the medal caught by the first step 113 and the second step 114 to slidingly roll into the first medal slot 108-1 and the second medal slot 109-1 under the influence of gravity. In other words, for the purpose of allowing the medal caught by the first step 113 and the second step 114 to slidingly roll into the first medal slot 108-1 and the second medal slot 109-1 under the influence of gravity, it is only necessary for the first step 113 and the second step 114 to be entirely sloped down to the first medal slot 108-1 and the second medal slot 109-1. In short, it is only necessary for the potential energy of the medal M caught by the first step 113 and the second step 114 to be entirely greater than the potential energy of the medal M located in positions of the first medal slot 108-1 and of the second medal slot 109-1. For example, even if a rising portion is formed in the intermediate portion of the first step 113 and the second step 114, when the kinetic energy of the medal M is greater than the sum of the potential energy and the frictional energy of the rising portion, the medal M climbs the rising portion with the momentum of the rotational movement performed so far and then rolls into the first slot. In addition, when a rising portion is formed in the intermediate portion of the first step 113 and the second step 114 and the kinetic energy of the medal M is less than the sum of the potential energy and the frictional energy of the rising portion, this is not a matter as long as the medal M is capable of climbing the rising portion and then rolling into the first slot by being pushed by another medal M rotationally moving from behind. Also, the first step 113 and the second step 114 may be sloped down and extended in a stepped pattern toward the first medal slot 108-1 and the second medal slot 109-1.

According to the medal shooting mechanism 100 of the above described first embodiment of the present invention, even when a game player continuously shoots the game medium for a long time, it becomes possible to largely reduce game player's tiredness. In addition, a game player does not wear out ones nerves for shooting the game medium, and thus the game player is capable of concentrating on the game itself and really enjoying the game.

Modified Example 1 of First Embodiment

Figure 7:
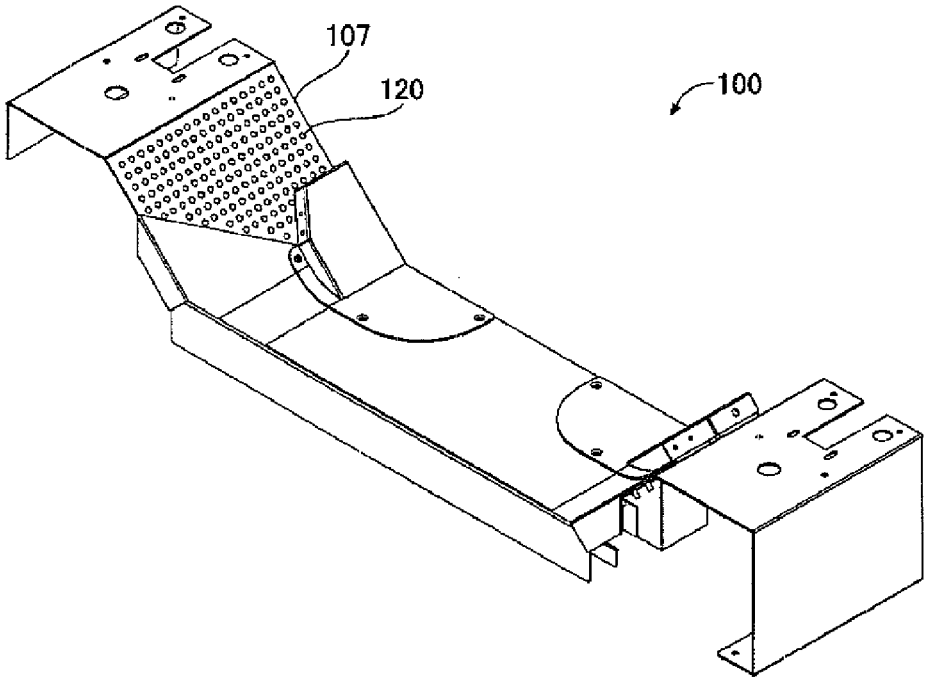
FIG. 7 is a perspective view illustrating a medal shooting mechanism in accordance with a first modified example of the first embodiment of the present invention.

A first modified example of the above described first embodiment will be hereinafter explained with reference to a figure. FIG. 7 is a perspective view illustrating a medal shooting mechanism of the first modified example of the first embodiment of the present invention. Only differences between the above described first embodiment and the fifth modified example are hereinafter explained, and the overlapping explanation will be hereinafter omitted.

A configuration that a plurality of scattered protrusions 120 are formed in the first sloped wall upper area 106 and the second sloped wall upper area 107 instead of forming the plurality of first ridge-shaped protrusions 115 and the plurality of second ridge-shaped protrusions 116 effectively works for reducing the contact area between the medal M and the first sloped wall upper area 106 and the second sloped wall upper area 107, and furthermore works for reducing the frictional resistance to be generated between the medal M and the first sloped wall upper area 106 and the second sloped wall upper area 107. Here, it is preferable to set intervals between adjacent protrusions 120 to be sufficiently less than diameter dimension of the medal M. Furthermore, it is preferable to form the plurality of protrusions 120 to be regularly scattered at predetermined intervals. With the configuration, the medal M that rolls on the first step 113 and the second step 114 slidingly makes contact with the plurality of scattered protrusions 120. Accordingly, the contact area between the medal M and the first sloped wall upper area 106 and the second sloped wall upper area 107 is reduced, and thus it is possible to effectively reduce the frictional force. From the perspective of reduction of the frictional force, it is preferable to form the plurality of protrusions 120 such that the top thereof is processed to be in a round shape.

Modified Example 2 of First Embodiment

Figure 8:
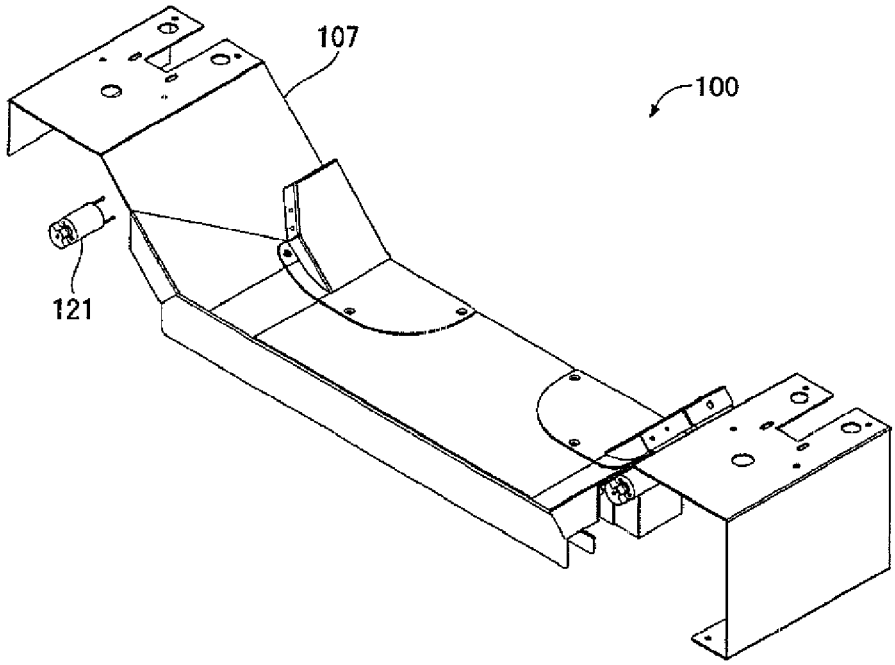
FIG. 8 is a perspective view illustrating a medal shooting mechanism in accordance with a second modified example of the first embodiment of the present invention.

A second modified example of the above described first embodiment will be hereinafter explained with reference to a figure. FIG. 8 is a perspective view illustrating a medal shooting mechanism of the second modified example of the first embodiment of the present invention. Only differences between the above described first embodiment and the fifth modified example are hereinafter explained, and the overlapping explanation will be hereinafter omitted. Only differences between the above described first embodiment and the second modified example are hereinafter explained, and the overlapping explanation will be hereinafter omitted.

The medal M and the first sloped wall and the second sloped wall are prevented from closely making contact with each other by applying minute vibration to the first sloped wall and the second sloped wall. As a result, it becomes possible to reduce the effective contact area between the medal M and the first sloped wall and the second sloped wall, and thus it becomes possible to effectively reduce the frictional force. It should be paid attention for avoiding a situation that the medal M instably rolls along the first step 113 and the second step 114 when too much vibration is applied to the first sloped wall and the second sloped wall. In addition, too much vibration is not preferable because it may make a game player discomfort.

Modified Example 3 of First Embodiment

Figure 9:
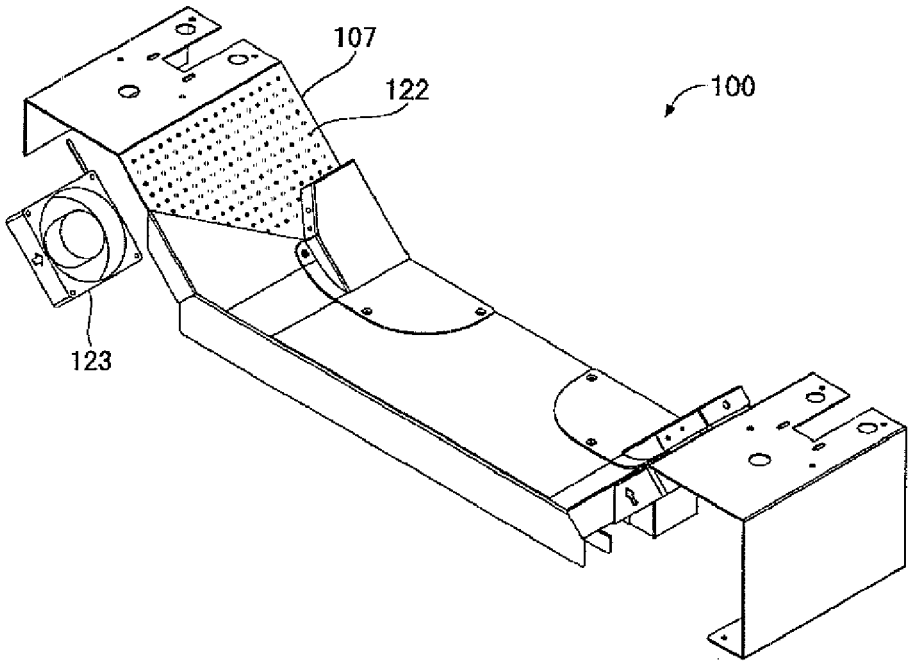
FIG. 9 is a perspective view illustrating a medal shooting mechanism in accordance with a third modified example of the first embodiment of the present invention.

A third modified example of the above described first embodiment will be hereinafter explained with reference to a figure. FIG. 9 is a perspective view illustrating a medal shooting mechanism of the third modified example of the first embodiment of the present invention. Only differences between the above described first embodiment and the fifth modified example are hereinafter explained, and the overlapping explanation will be hereinafter omitted.

In order to reduce the frictional force between the medal M and the first sloped wall and the second sloped wall, the first sloped wall upper area 106 and the second sloped wall upper area 107 have a plurality of scattered vent holes 122, respectively, and a ventilation fan 123 is provided on the back sides of the first sloped wall upper area 106 and the second sloped wall upper area 107, respectively.

Buoyancy for floating the medal M from the first sloped wall upper area 106 and the second sloped wall upper area 107 is applied to the medal M by ventilation through the plurality of vent holes 122. Accordingly, the contact force between the medal M and the first sloped wall upper area 106 and the second sloped wall upper area 107 is reduced. As a result, the frictional force between the medal and the first sloped wall upper area 106 and the second sloped wall upper area 107 is reduced. Here, it is preferable to set intervals between adjacent vent holes 122 to be sufficiently less than diameter dimension of the medal M. Furthermore, it is preferable to form the plurality of vent holes 122 to be regularly scattered at predetermined intervals. In addition, it is possible to achieve the ventilation fan 123 by disposing it on the back sides of the first sloped wall upper area 106 and the second sloped wall upper area 107, respectively. With the configuration, it becomes possible to efficiently reduce the frictional resistance because the medal M rolls along the first step 113 and the second step 114 in a state that the contact force between the medal M and the first sloped wall upper area 106 and the second sloped wall upper area 107 is reduced by buoyancy applied by the ventilation through the plurality of scattered vent holes 122.

Modified Example 4 of First Embodiment

Figure 10:
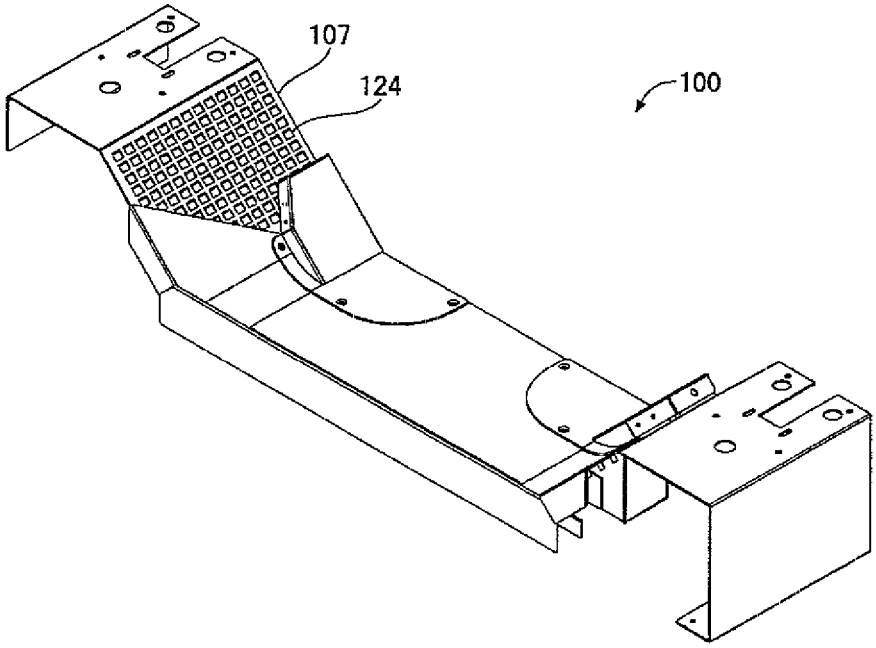
FIG. 10 is a perspective view illustrating a medal shooting mechanism in accordance with a fourth modified example of the first embodiment of the present invention.

A fourth modified example of the above described first embodiment will be hereinafter explained with reference to a figure. FIG. 10 is a perspective view illustrating a medal shooting mechanism of the fourth modified example of the first embodiment of the present invention. Only differences between the above described first embodiment and the fifth modified example are hereinafter explained, and the overlapping explanation will be hereinafter omitted.

It is possible to provide a configuration that the first sloped wall upper area 106 and the second sloped wall upper area 107 are made up of a reticulate sloped wall 124, respectively, as another effective method for reducing the frictional force between the medal M and the first sloped wall and the second sloped wall. Here, reticulated grid intervals are set to be sufficiently less than diameter dimension of the medal M. When the first sloped wall upper area 106 and the second sloped wall upper area 107 are made up of the reticulate sloped wall 124, respectively, the contact area between the medal M and the first sloped wall upper area 106 and the second sloped wall upper area 107 is reduced. Thus it becomes possible to effectively reduce the frictional resistance.

Modified Example 5 of First Embodiment

Figure 11:
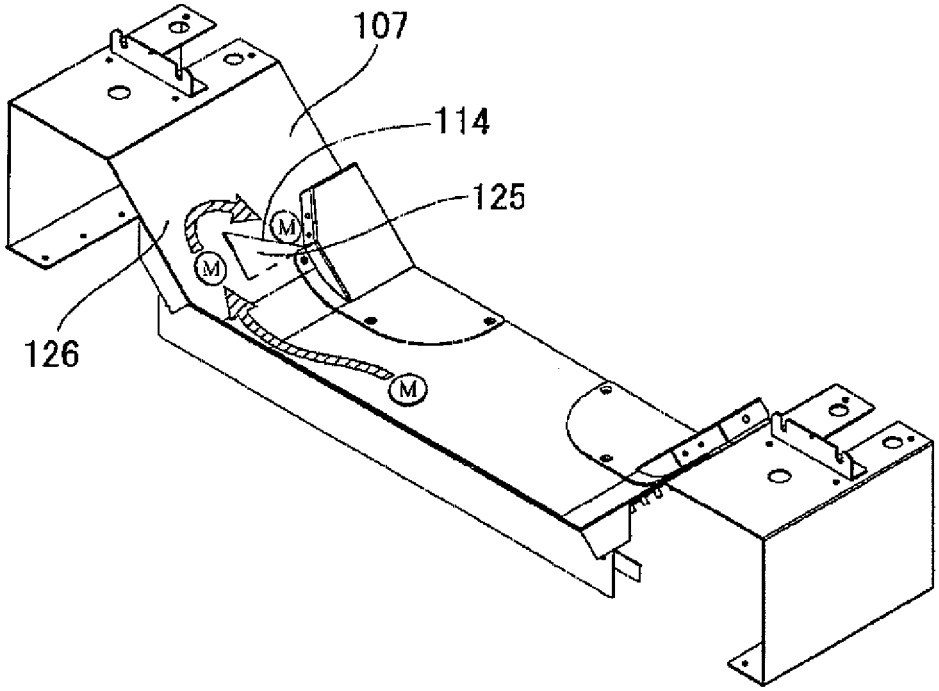
FIG. 11 is a perspective view illustrating a medal shooting mechanism in accordance with a fifth modified example of the first embodiment of the present invention.

A fifth modified example of the above described first embodiment will be hereinafter explained with reference to a figure. FIG. 11 is a perspective view illustrating a medal shooting mechanism of the fifth modified example of the first embodiment of the present invention. Only differences between the above described first embodiment and the fifth modified example are hereinafter explained, and the overlapping explanation will be hereinafter omitted.

In the above described embodiment, each sloped wall is made up of a sloped wall upper area and a sloped wall lower area, and a step making up a guide is formed along a boundary between the sloped wall upper area and the sloped wall lower area. The step is configured to be extended to a medal slot from a lateral portion of the sloped wall upper area that is located on the opposite side from the medal slot. In other words, the step is configured to be extended on the entire area of the sloped wall. On the other hand, according to the modified example 5, it is possible to configure the step to be extended to the medal slot from an inner position that is separated from the lateral portion of the sloped wall upper area located on the opposite side from the medal slot at distance greater than or equal to diameter dimension of the single medal. When the step is extended from the inner position that is separated from the lateral portion of the sloped wall upper area at distance of the diameter dimension of the single medal, it becomes possible to move the medal to the sloped wall upper area through a sloped plane on which a step is not formed.

The above configuration will be hereinafter explained in detail with reference to FIG. 11. The second sloped wall is formed by a second sloped wall upper area 107, a third sloped wall lower area 125, and a fourth sloped wall lower area 126. The second step 114 that makes up the second guide is formed along the boundary between the third sloped wall lower area 125 and the second sloped wall upper area 107. The fourth sloped all lower area 126 and the second sloped wall upper area 107 form a plain, and no step is formed on the boundary between the fourth sloped wall lower area 126 and the second sloped wall upper area 107. It is possible to form the third sloped all lower area 125 by an approximately wedge-shaped flat plate that is provided on the single plane formed by the fourth sloped wall lower area 126 and the second sloped wall upper area 107. In this case, thickness of the approximately wedge-shaped flat plate corresponds to width of the step of the above described second step 114. Therefore, the thickness is determined based on the step width of the above described second step 114. Furthermore, it is required for the fourth sloped wall lower area 126 to have horizontal dimension greater than the diameter of the medal M in order to make the medal M move to the second sloped wall upper area 107 through the fourth sloped wall lower area 126.

With the configuration, a game player moves the medal M from the accumulating part 101 to the second sloped wall upper area 107 through the fourth sloped wall lower area 126, and further moves it to an upper position of the third sloped wall lower area 125, while the game player presses the medal M with one's finger. When the game player releases the medal M on the position, the medal M slidingly falls along the second sloped wall upper area 107, and is then caught by the second step 114 that is made up of the upper side of the approximately wedge-shaped flat plate. Then, as described above, the medal M slidingly rolls into the second medal slot 109-1 along the second step 114. According to the configuration, no step is formed on the boundary between the fourth sloped wall lower area 126 and the second sloped wall upper area 107. Therefore, it becomes possible to move the medal M to the second sloped wall upper area 107 without crossing over the second step 114.

It is possible to form the third sloped wall lower area 125 by an approximately wedge-shaped plate with non-uniform thickness, instead of the approximately wedge-shaped flat plate. Specifically, it is possible to form the upper side of the approximately wedge-shaped plate to have thickness corresponding to the step width of the second step 114. On the other hand, it is possible to form the lower side of the approximately wedge-shaped plate to have thickness of substantially zero by forming the approximately wedge-shaped plate to have thickness gradually reducing from the upper side to the lower side. With the configuration, it is not required to form a step on the lower side of the third sloped wall lower area 125.

With the configuration, a game player may move the medal M from the accumulating part 101 to the second sloped wall upper area 107 through the fourth sloped wall lower area 126 while the game player presses the medal M with one's finger. Also, the game player may move the medal M to the second sloped wall upper area 107 through the third sloped wall lower area 125 while the game player presses the medal M with one's finger, because no step is formed on the lower side of the third sloped wall lower area 125. When the game player moves the medal M to an upper position of the third sloped wall lower area 125 and then releases the medal M on the position, the medal M slidingly falls along the second sloped wall upper area 107, and is caught by the second step 114 that is made up of the upper side of the approximately wedge-shaped flat plate. Then, as described above, the medal M slidingly rolls into the second medal slot 109-1 along the second step 114.

(2) Second Embodiment

Figure 12:
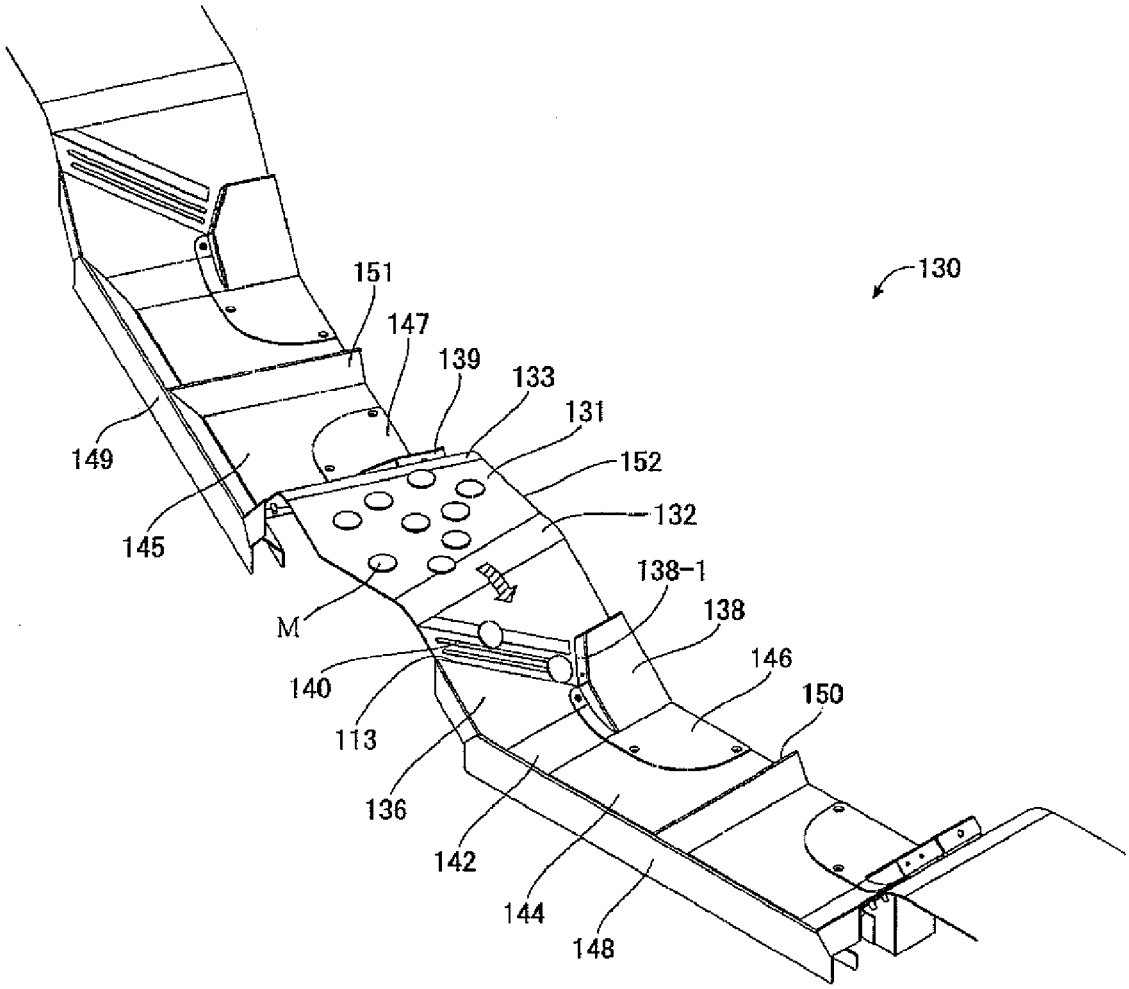
FIG. 12 is a perspective view illustrating a medal shooting mechanism in accordance with a second embodiment of the present invention.
Figure 13:
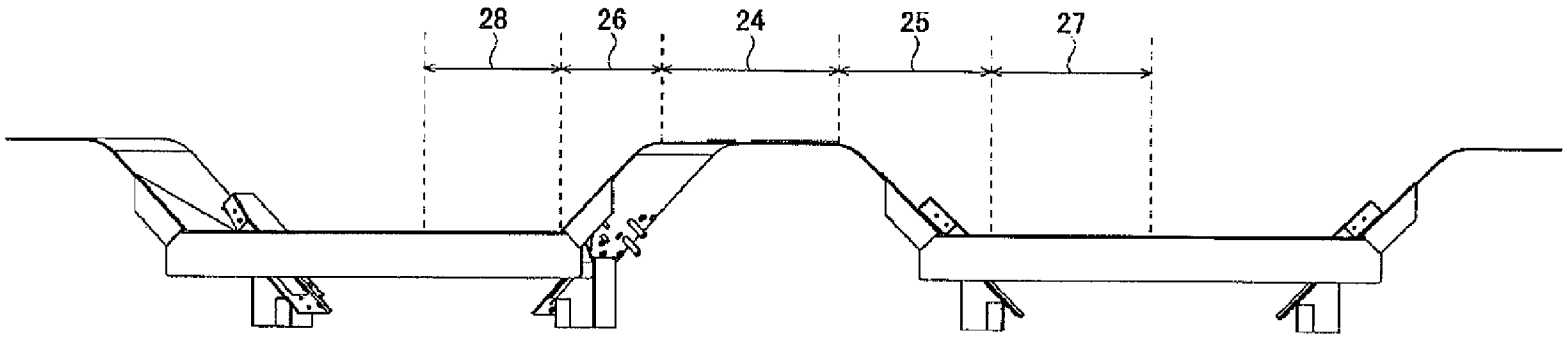
FIG. 13 is a front view of the medal shooting mechanism illustrated in FIG. 12.
Figure 14:
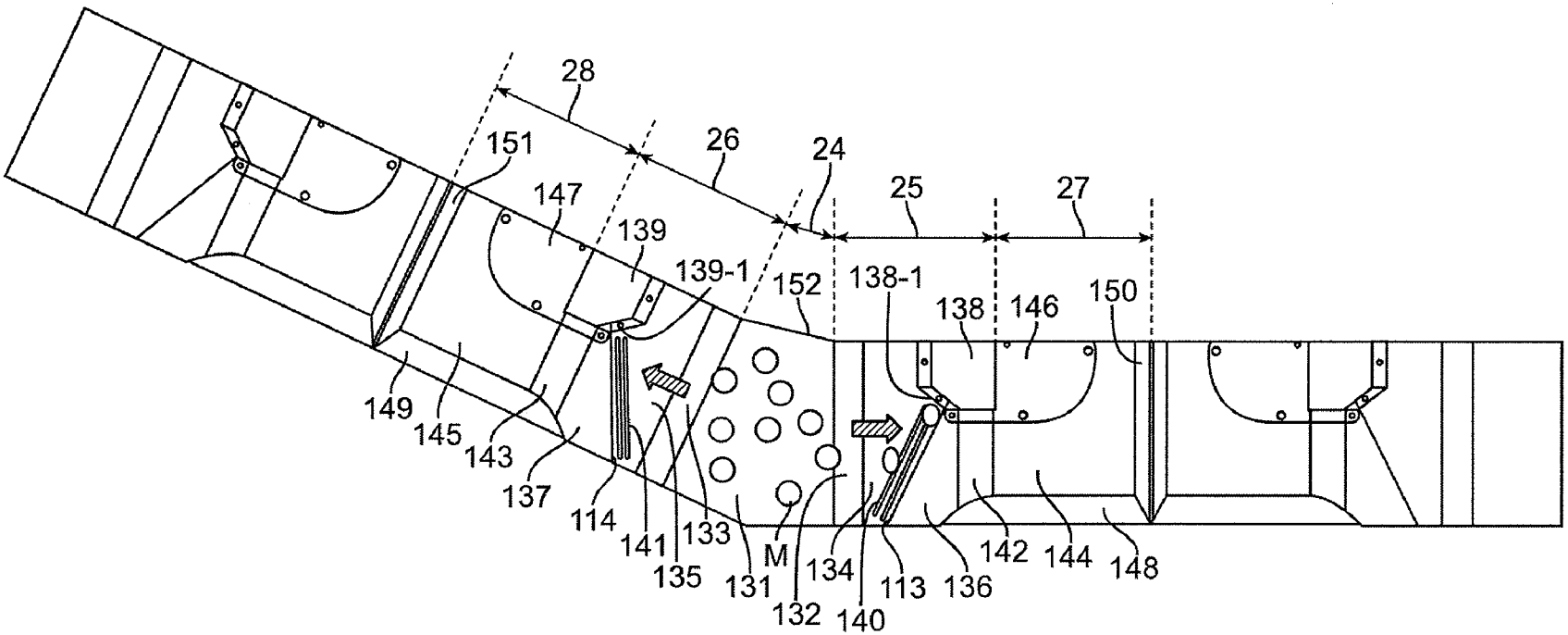
FIG. 14 is a top view of the medal shooting mechanism illustrated in FIG. 12.
Figure 15:
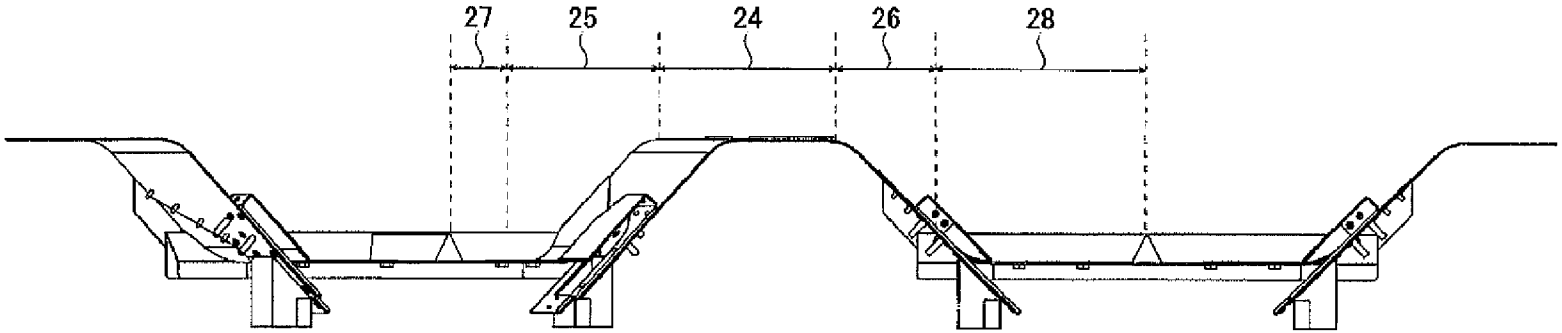
FIG. 15 is a back view of the medal shooting mechanism illustrated in FIG. 12.

FIG. 12 is a perspective view illustrating a medal shooting mechanism of a second embodiment of the present invention. FIG. 13 is a front view of the medal shooting mechanism illustrated in FIG. 12. FIG. 14 is a top view of the medal shooting mechanism illustrated in FIG. 12. FIG. 15 is a back view of the medal shooting mechanism illustrated in FIG. 12.

A medal shooting mechanism 130 includes a flat area 24, a first sloped area 25 and a second sloped area 26 that are located on the both sides of the flat area 24, a first lower flat area 27 that is located external to the first sloped area 25, and a second lower flat area 28 that is located external to the second sloped area 26. The medal shooting mechanism 130 includes an upper accumulating part 131 on which a plurality of medals are accumulated. The upper accumulating part 131 makes up the upper flat area 24 of the medal shooting mechanism 130. The medal shooting mechanism 130 includes the lower accumulating part 144 on which a plurality of medals are accumulated. The first lower accumulating part 144 makes up the first lower flat area 27 of the medal shooting mechanism 130. The medal shooting mechanism 130 includes the second lower accumulating part 145 on which a plurality of medals are accumulated. The second lower accumulating part 145 makes up the second lower flat area 28 of the medal shooting mechanism 130.

The medal shooting mechanism 130 further includes a first sloped wall that is continuously sloped down and extended from a first boundary area 132 adjacent to a first lateral portion of the upper accumulating part 131. The first sloped wall makes up the first sloped area 25. The first sloped wall is formed by the first sloped wall lower area 136 and the first sloped wall upper area 134. The first boundary area 132 is formed by a curved surface.

The medal shooting mechanism 130 further includes a second sloped wall that is continuously sloped down and extended from a second boundary area 133 adjacent to a second lateral portion of the upper accumulating part 131, which is located on the opposite side from the above described first lateral portion. The second sloped wall makes up the second sloped area 26. The second sloped wall is formed by the second sloped wall lower area 137 and the second sloped wall upper area 135. The second boundary area 133 is formed by a curved surface.

The medal shooting mechanism 130 further includes a first lower accumulating part 144 that is continuously and horizontally extended through the third boundary area 142 adjacent to the outer portion of the first sloped wall lower area 136. The first lower accumulating part 144 makes up the first lower flat area 27.

The medal shooting mechanism 130 further includes a second lower accumulating part 145 that is continuously and horizontally extended through the fourth boundary area 143 adjacent to the outer portion of the second sloped wall lower area 137. The second lower accumulating part 145 makes up the second lower flat area 28.

The medal shooting mechanism 130 further includes a first medal shooter 138 that includes a first medal slot 138-1 on a position adjacent to the first sloped wall, and a second medal shooter 139 that includes a second medal slot 139-1 on a position adjacent to the second sloped wall. The first boundary area 132, the first sloped wall lower area 136, the first sloped wall upper area 134, the first medal shooter 138, and the third boundary area 142 from the first sloped area 25 of the medal shooting mechanism 130. The second boundary area 133, the second sloped wall lower area 137, the second sloped wall upper area 135, the second medal shooter 139, and the fourth boundary area 143 form the second sloped area 26 of the medal shooting mechanism 130.

The first medal shooter 138 further includes a first attached flange 146. The first attached flange 146 is extended from a part of the third boundary area 142 to a part of the first lower accumulating part 144. The second medal shooter 139 further includes a second attached flange 147. The second attached flange 147 is extended from a part of the fourth boundary area 143 to a part of the second lower accumulating part 145. As illustrated in FIG. 14, the first attached flange 146 extended on the first lower accumulating part 144, and the second attached flange 147 extended on the second lower accumulating part 145 respectively have a largely-rounded corner. The first attached flange 146 and the second attached flange 147 delimit a medal accumulating area on which a medal M is accumulated on the first lower accumulating part 144 and the second lower accumulating part 145. The medal is supplied from a medal supplying side 152 of the upper accumulating part 131. A first medal constraining plate 148 for preventing the medal M from falling from the first lower accumulating part 144, and a first lower accumulating part partition 150 for separating the medal M to be accumulated on the first lower accumulating part 144 from the medal M to be accumulated in an adjacent medal shooting mechanism, are provided for the first lower accumulating part 144. A second medal constraining plate 149 for preventing the medal M from falling from the second lower accumulating part 145, and a second lower accumulating part partition 151 for separating the medal M to be accumulated on the second lower accumulating part 145 from the other medal M to be accumulated in an adjacent medal shooting mechanism, are provided for the second lower accumulating part 145. Furthermore, a medal constraining plate for preventing the medal M from falling from the front side of the upper accumulating part 131 may be provided, although not illustrated in the figure.

A first guide 113 is formed on the boundary between the first sloped wall lower area 136 and the first sloped wall upper area 134. The first guide 113 is configured to catch the medal slidingly falling along the first sloped wall upper area 134 and is also configured to make the medal slidingly roll into the first medal slot 138-1 along the first guide. The first guide 113 is formed by a first step 113 formed on the boundary between the first sloped wall lower area 136 and the first sloped wall upper area 134. The first step 113 is linearly sloped down and extended to the first medal slot 138-1. The first sloped wall upper area 134 includes at least one protrusion that is formed to reduce friction to be generated between the first sloped wall upper area 134 and the medal M slidingly rolling along the first guide 113. In other words, the first sloped wall upper area 134 includes at least one ridge-shaped protrusion 140 that is separated upward from the first guide 113 at distance less than diameter of the medal M and is extended approximately in parallel with a direction in which the first guide 113 is extended. Specifically, a plurality of ridge-shaped protrusions 140 are formed as illustrated in the figure.

A second guide 114 is formed on the boundary between the second sloped wall lower area 137 and the second sloped wall upper area 135. The second guide 114 is configured to catch the medal slidingly falling along the second sloped wall upper area 135 and is also configured to make the medal slidingly roll into the second medal slot 139-1 along the second guide. The second guide 114 is formed by a second step 114 formed on the boundary between the second sloped wall lower area 137 and the second sloped wall upper area 135. The second step 114 is linearly sloped down and extended to the second medal slot 139-1. The second sloped wall upper area 135 includes at least one protrusion that is formed to reduce friction to be generated between the second sloped wall upper are 135 and the medal M slidingly rolling along the second guide 114. In other words, the second sloped wall upper area 135 includes at least one ridge-shaped protrusion 141 that is separated upward from the second guide 114 at distance less than diameter of the medal M and is extended approximately in parallel with a direction in which the second guide 114 is extended. Specifically, a plurality of ridge-shaped protrusions 141 are formed as illustrated in the figure.

When the upper accumulating part 131, the first boundary area 132, the second boundary area 133, the first sloped wall lower area 136, the second sloped wall lower area 137, the first sloped wall upper area 134, the second sloped wall upper area 135, the third boundary area 142, the fourth boundary area 143, the first lower accumulating part 144, and the second lower accumulating part 145 are formed in one member, no seam is formed in the area on which the medal M is movable. Accordingly, it becomes possible to reduce the resistance.

Also, the first medal slot 138-1 of the first medal shooter 138 and the second medal slot 139-1 of the second medal shooter 139 have dimensions that only one medal M is allowed to be inserted thereunto at a time. The configuration serves to reliably prevent a situation that a plurality of medals M are stuck in the first medal shooter 138 or the second medal shooter 139 when the medals M are simultaneously inserted into the first medal slot 138-1 or the second medal slot 139-1.

The above described medal shooting mechanism 130 has an approximately symmetrical shape and structure with reference to the middle position between the first and second lateral portions.

The first medal shooter 138 and the second medal shooter 139 are formed in the same structure as the above described first medal shooter 108 and second medal shooter 109, which are explained with reference to FIG. 6. Therefore, the internal structure thereof will be hereinafter omitted.

When a game player slides the medal M accumulated on the upper accumulating part 131 to the upper area of the first sloped wall upper area 134 and the upper area of the second sloped wall upper area 135, which are continuously sloped down extended from the upper accumulating part 131, and then releases the medal M, the medal M slidingly falls along the first sloped wall upper area 134 and the second sloped wall upper area 135 under the influence of gravity and is caught by the first step 113 making up the first guide 113 and by the second step 114 making up the second guide 114. Also, the first step 113 and the second step 114 are configured to make the medal M slidingly roll into the first medal slot 138-1 and the second medal slot 139-1 under the influence of gravity.

In other words, if a game player moves the medal M to the upper area of the first sloped wall upper area 134 and the upper area of the second sloped wall upper area 135, which are continuously sloped down and extend from the upper accumulating part 131 and then releases the medal M, the medal M slidingly falls along the first sloped wall upper area 134 and the second sloped wall upper area 135 under the gravity and is caught by the first step 113 and the second step 114. Then, the medal M slidingly rolls into the first medal slot 138-1 of the first shooter and the second medal slot 139-1 along the first step 113 and the second step 114 under the gravity. When the medal M rolls along the first step 113 and the second step 114, the medal M is going to slide with respect to the first sloped wall upper area 134 and the second sloped wall upper area 135. In other words, it is only necessary for a game player to move the medal M to the upper area of the first sloped wall upper area 134 and the upper area of the second sloped wall upper area 135 and then release the medal M. Therefore, it is not required for a game player to manually carry the medal M from the upper accumulating part 131 to the first medal slot 138-1 and the second medal slot 139-1 as is conventionally performed. In other words, this makes a game player comfortably move one's hand by making use of the gravity.

Furthermore, there is a possibility that the medal M is not caught by the first step 113 and the second step 114. In this case, the medal M slidingly falls along the first and second sloped walls across the first step 113 and the second step 114, and reaches the first and second lower accumulating parts 144 and 145. Thus the medal M is accumulated thereon. It is possible to directly use the game medium accumulated on the first and second lower accumulating parts 144 and 145. If a game player slides the medal M that are accumulated on the first and second lower accumulating parts 144 and 145 upward along the first and second sloped walls and then releases the medal M, the medal M slidingly falls along the first sloped wall upper area 134 and the second sloped wall upper area 135 under the influence of gravity and is caught by the first step 113 and the second step 114. Then, the medal M slidingly rolls into the first medal slot 138-1 and the second medal slot 139-1 along the first step 113 and the second step 114 under the influence of gravity. The mechanism is the same as that explained in the above described first embodiment.

Accordingly, even when a game player continuously shoots the medal M for a long time, it is possible to largely reduce game player's tiredness. In addition, a game player does not wear out ones nerves too much for shooting the medal M, and thus the game player is capable of concentrating on the game itself and really enjoying the game.

Also, if a game player moves the medal M to the upper area of the first sloped wall upper area 134 and the upper area of the second sloped wall upper area 135, which are continuously sloped down and extended from the upper accumulating part 131 and then releases the medal M, the medal M slidingly falls along the first sloped wall upper area 134 and the second sloped wall upper area 135 under the influence of gravity and is caught by the first step 113 and the second step 114. Then, the medal M slidingly rolls into the first medal slot 138-1 and the second medal slot 139-1 along the first step 113 and the second step 114 under the influence of gravity. Furthermore, If a game player slides the medal M, which falls along the first sloped wall lower area 136 and the second sloped wall lower area 137 without being caught by the first step 113 and the second step 114 and is then accumulated on the first lower accumulating part 144 and the second lower accumulating part 145, upward along the first and second sloped walls and then releases the medal, the medal falls along the first sloped wall upper area 134 and the second sloped wall upper area 135 under the influence of gravity, and is caught by the first step 113 and the second step 114. Then, the medal M slidingly rolls into the first medal slot 138-1 and the second medal slot 139-1 along the first step 113 and the second step 114 under the influence of gravity. In other words, it becomes possible to largely reduce game player's tiredness even when the game player continuously shoots the medal M for a long time without automating shooting of the medal M. Accordingly, it becomes possible to really fascinate a game player for a long time while the game player feels that the game player oneself actively plays the game.

It is only necessary for the first step 113 and the second step 114 to have a function of catching the medal M that slidingly falls along the first sloped wall upper area 134 and the second sloped wall upper area 135 under the influence of gravity, and a function of making the medal M slidingly roll into the first medal slot 138-1 and the second medal slot 139-1 along the first step 113 and the second step 114 under the influence of gravity. However, it is required to slidingly move the medal M accumulated on the first and second lower accumulating parts 144 and 145 to a position higher than the first guide 113 (i.e., the first step) and the second guide 114 (i.e., the second step 114). Therefore, it is preferable that the first guide 113 (i.e., the first step 113) and the second guide 114 (i.e., the second step 114) do not block movement of the medal M, when the medal M is slidingly moved upward. In consideration of this, it is meaningful that the first guide 113 is formed by the first step 113 and the second guide 114 is formed by the second step 114. Note that an important point is that the step surfaces of the first and second steps 113 and 114 face upward. With the configuration, it becomes easy to slidingly move the medal M upward across the first step 113 and the second step 114. In addition, it becomes possible to catch the medal M on the step surfaces of the first step 113 and the second step 114, when the medal M once slidingly moved upward is released from a hand of a game player and slidingly falls along the first sloped wall upper area 134 and the second sloped wall upper area 135. When the step surfaces of the first step 113 and the second step 114 face downward, it is impossible to block the medal M that slidingly moves upward along the first sloped wall lower area 136 and the first sloped wall upper areas 134, and the second sloped wall lower area 137 and the second sloped wall upper area 135, and it is also impossible to make the medal M slidingly roll into the first medal slot 138-1 and the second medal slot 139-1 under the influence of gravity while the medal M is caught.

It is possible to achieve the first step 113 by forming the first sloped wall lower area 136 to have thickness greater than the first sloped wall upper area 134. In addition, it is possible to achieve the second step 114 by forming the second sloped wall lower area 137 to have thickness greater than the second sloped wall upper area 135. For example, the first sloped wall and the second sloped wall may be formed by combining a first flat plate that is extended in both of the upper and lower areas and a second flat plate that is extended only in the lower area. In addition, the first sloped wall and the second sloped wall may be formed such that only the lower area of the first flat plate that is extended in both of the upper and lower areas is thinly processed. In both cases, it is possible to achieve the first step 113 and the second step 114 with an existing technique.

Also, it is possible to form the first step 113 and the second step 114 to be extended to the first medal slot 138-1 and the second medal slot 139-1. In this case, it is required to make the medal M caught by the first step 113 and the second step 114 roll toward the first medal slot 138-1 and the second medal slot 139-1 under the influence of gravity. Accordingly, the first step 113 and the second step 114 are sloped down and extended to the first medal slot 138-1 and the second medal slot 139-1. Specifically, the first step 113 and the second step 114 are formed to be linearly sloped down to the first medal slot 138-1 and the second medal slot 139-1. However, as a modified example, it is possible to form the first step 113 and the second step 114 to be curvilinearly sloped down to the first medal slot 138-1 and the second medal slot 139-1. Furthermore, it is also possible to form the first step 113 and the second step 114 by the combination of linear and curvilinear shapes. However, regardless of a position in the first step 113 and the second step 114 where the medal M is caught, the first step 113 and the second step 114, respectively, have the minimum-required slope angle for making the medal M roll toward the first medal slot 138-1 and the second medal slot 139-1 under the influence of gravity.

Furthermore, it is required to form the abutment portions of the first step 113 and the second step 114 for making the medal M slidingly roll into the first medal slot 138-1 and the second medal slot 139-1 under the gravity. The abutment portions of the first step 113 and the second step 114 are disposed adjacent to the first medal slot 138-1 and the second medal slot 139-1. It is possible to provide a modified example that the abutment portions of the first step 113 and the second step 114 are not adjacently disposed to the first medal slot 138-1 and the second medal slot 139-1 and thus gaps are generated between the first step 113 and the first medal slot 138-1, and between the second step 114 and the second medal slot 139-1. This is not a matter as long as the medal M rolling along the first step 113 and the second step 114 finally rolls into the first medal slot 138-1 and the second medal slot 139-1. For this purpose, the first medal slot 138-1 of the first shooter 138 and the second medal slot 139-1 of the second shooter 139 are disposed adjacent to the first sloped wall and the second sloped wall.

In addition, widths of the step surfaces of the first step 113 and the second step 114, in other words, dimensions of the first step 113 and the second step 114, are determined such that the step surfaces of the first step 113 and the second step 114 are capable of catching the medal M that slidingly falls along the first sloped wall upper area 134 and the second sloped wall upper area 135. The minimum-required dimension of the first step 113 and the second step 114 depend on slope angles of the first sloped wall and the second sloped wall and the thickness of the medal M. For example, when the first sloped wall and the second sloped wall are formed to have large slope angles, the step surfaces of the first step 113 and the second step 114 are supposed to be formed to have widths greater than those of a case that the first sloped wall and the second sloped wall are formed to have small slope angles.

Furthermore, when the step surfaces of the first step 113 and the second step 114 are formed to have widths much less than thickness of the medal M, it is impossible to catch the medal M that slidingly falls along the first sloped wall upper area 134 and the second sloped wall upper area 135, and then the medal M slidingly falls to the first lower accumulating part 144 and the second lower accumulating part 145 across the first step 113 and the second step 114. As a result, it is impossible to insert the medal M into the first medal slot 138-1 and the second medal slot 139-1. Therefore, in consideration of thickness of the medal M and the slope angles of the first sloped wall and the second sloped wall, it is required for the step surfaces of the first step 113 and the second step 114 to have the minimum-required widths for catching the medal M that slidingly falls along the first sloped wall upper area 134 and the second sloped wall upper area 135. When the step surfaces of the first step 113 and the second step 114 are formed to have widths greater than thickness of the medal M, it is possible to increase the likelihood of catching the medal M that slidingly falls along the first sloped wall upper area 134 and the second sloped wall upper area 135. In addition, when the step surfaces of the first step 113 and the second step 114 are formed to have greater than twice the thickness of the medal M, it becomes possible to simultaneously catch two overlapping medals M that slidingly fall along the first sloped wall upper area 134 and the second sloped wall upper area 135. It should be note that when widths of the step surfaces of the first step 113 and the second step 114 are formed to be too large, the medal M may flop on the first step 113 and the second step 114 while the medal M is slidingly moved upward across the first step 113 and the second step 114, and thus there is a possibility that the medal M does not smoothly roll across the first step 113 and the second step 114.

As illustrated in FIG. 21, in a case that the peripheral portion of the medal M is formed to have a non-rectangular cross-section so that the corners of the cross-section are formed to have rounds R, the medal M may be caught by the first step 113 and the second step 114 when the step surfaces of the first step 113 and the second step 114 are formed to have widths W2 greater than or equal to thickness R of the round shaped portions. However, in a practical situation, the medal M that slidingly falls along the first sloped wall upper area 134 and the second sloped wall upper area 135 may not be caught by the first step 113 and the second step 114 as a result of impact and/or vibration to be generated when the medal M makes contact with the first step 113 and the second step 114. Therefore, the step surfaces of the first step 113 and the second step 114 are designed to have widths greater than the theoretically minimum-required width W2. Furthermore, as illustrated in FIG. 21, for the purpose of simultaneously catching the two overlapping medals M that slidingly fall along the first sloped wall upper area 134 and the second sloped wall upper area 135, the two overlapping medals M may be theoretically caught when the step surfaces of the first step 113 and the second step 114 are formed to have widths W1 greater than or equal to the sum of thickness of the single medal M and thickness R of the round shaped portion. However, in a practical situation, impact and/or vibration are/is generated when two overlapping medals M slidingly fall along the first sloped wall upper area 134 and the second sloped wall upper area 135 and make contact with the first step 113 and the second step 114. Accordingly, one of the two medals M, which is overlapped on the other, may not be caught by the first step 113 and the second step 114. Therefore, for the purpose of catching both of the two overlapping medals M, the step surfaces of the first step 113 and the second step 114 are designed to have widths greater than the theoretically minimum-required width W1.

From the perspective, in order to catch the single medal M, it is preferable to design the step surface of the first step to have width approximately corresponding to thickness of the single game medium. Here, "approximately" corresponding to thickness of the single game medium means that the width includes error corresponding to the thickness R of the round shaped portion.

Furthermore, angle of the step surface of the first step is preferably right angle or acute angle with respect to the first sloped wall. When the angle of the step surface of the first step is set to be obtuse angle with respect to the first sloped wall, there is a high possibility that the game medium that slidingly falls along the first sloped wall slidingly falls without being caught by the first step.

When the first sloped wall and the second sloped wall are formed to have large slope angles, in other words, when the first sloped wall lower area 136 and the first sloped wall upper area 134, and the second sloped wall lower area 137 and the second sloped wall upper area 135 are formed to be nearly perpendicular, it becomes difficult to slidingly move the medal M upward from the lower accumulating part 144 to the first sloped wall lower area 136 and the first sloped wall upper area 134, and it is also becomes difficult to slidingly move the medal M upward from the second lower accumulating part 145 to the second sloped wall lower area 137 and the second sloped wall upper area 135. On the other hand, when the first sloped wall and the second sloped wall are formed to have small slope angles, in other words, when the first sloped wall lower area 136 and the first sloped wall upper area 134, and the second sloped wall lower area 137 and the second sloped wall upper area 135 are formed to be nearly flat, it is easy to slide the medal M upward from the first lower accumulating part 144 to the first sloped wall lower area 136 and the first sloped wall upper area 134, and it is also easy to slide the medal M upward from the second lower accumulating part 145 to the second sloped wall lower area 136 and the second sloped wall upper area 135. However, when a game player releases the medal, the frictional force between the medal M and the first sloped wall and the second sloped wall will be increased. Accordingly, it becomes difficult for the medal M to slidingly fall along the first sloped wall upper area 134 and the second sloped wall upper area 135. In addition, the large frictional force is generated when the medal M slides on the first sloped wall upper area 134 and the second sloped wall upper area 135 while it rolls along the first step 113 and the second step 114 under the influence of gravity. Accordingly, there is a possibility that the medal M stops moving on the way to the first medal slot 138-1 and the second medal slot 138-2 and thus cannot reach the first medal slot 138-1 and the second medal slot 139-1. Therefore, in consideration of the above, it is required for the first sloped wall lower area 136 and the first sloped wall upper area 134, and the second sloped wall lower area 137 and the second sloped wall upper area 135 to have slope angle that is neither nearly perpendicular nor nearly flat. For example, it is preferable to set the first sloped wall lower area 136 and the first sloped wall upper area 134, and the second sloped wall lower area 137 and the second sloped wall upper area 135 to have the slope angle of 20-70 degrees. Furthermore, it is more preferable to set them to have the slope angle of 30-60 degrees. The first sloped wall lower area 136 and the first sloped wall upper area 134, and the second sloped wall lower area 137 and the second sloped wall upper area 135 may be typically set to have the slope angles of approximately 45 degrees.

Furthermore, for the purpose of slidingly moving the medal M to be accumulated on the first lower accumulating part 144 and the second lower accumulating part 145 upward to the first sloped wall lower area 136 and the second sloped wall lower area 137 with the minimum resistance, it is preferable to form the third boundary area 142 and the fourth boundary area 143 to be curved surfaces. The preferable curvature of the curved surfaces depends on diameter dimension of the medal M, but it is only necessary for the curved surfaces to have curvature radius sufficiently greater than diameter dimension of the medal M. It is possible to easily empirically decide the preferable curvature.

As described above, it is preferable to reduce the frictional resistance to be generated between the medal M and the first sloped wall and the second sloped wall as much as possible. A plurality of first ridge-shaped protrusions 140 and a plurality of second ridge-shaped protrusions 141 effectively work for reducing the frictional force. The medal M is formed in an approximately disk shape. Furthermore, when the first sloped wall upper area 134 and the second sloped wall upper area 135 are formed to have flat surfaces, the entire area of the lateral surface of the medal M makes contact with the flat surfaces of the first sloped wall upper area 134 and the second sloped wall upper area 135. Reducing the contact area between the medal M and the first sloped wall upper area 134 and the second sloped wall upper area 135 effectively works for reducing the frictional force between the medal M and the first sloped wall upper area 134 and the second sloped wall upper area 135. In order to reduce the contact area, the plurality of first ridge-shaped protrusions 140 and the plurality of second ridge-shaped protrusions 141 are formed in the first sloped wall upper area 134 and the second sloped wall upper area 135. With the configuration, the medal M that rolls on the first guide 113 (i.e., the first step 113) and the second guide 114 (i.e., the second step 114) slidingly makes contact with the plurality of first ridge-shaped protrusions 140 and the plurality of second ridge-shaped protrusions 141. Accordingly, the contact area between the medal M and the first sloped wall upper area 134 and the second sloped wall upper area 135 is reduced, and thus it is possible to effectively reduce the frictional force.

In order to reduce the frictional resistance, it is preferable to form at least surfaces of the first sloped wall upper area 134 and the second sloped wall upper area 135 with material having self-lubricating property. Only the surfaces may be formed with the material having the self-lubricating property, or the entirety of the first sloped wall upper area 134 and the second sloped wall upper area 135 may be formed with the material having the self-lubricating property. Furthermore, in addition to the first sloped wall upper area 134 and the second sloped wall upper area 135, the surfaces of or the entirety of the first sloped wall lower area 136, the second sloped wall lower area 137, the first boundary area 132, the second boundary area 133, the third boundary area 142, the fourth boundary area 143, the upper accumulating part 131, the first lower accumulating part 144, and the second lower accumulating part 145 may be formed with the material having the self-lubricating property. It is possible to take engineering plastic such as Teflon (registered trademark) and oil-impregnated sintered metal (example of commercial product: oilless metal plate) as a typical example of the material having the self-lubricating property. However, the material is not necessarily limited to this. Instead of forming at least the surfaces of the first sloped wall upper area 134 and the second sloped wall upper area 135 with the material having the self-lubricating property, it is possible to remove the plurality of first ridge-shaped protrusions 140 and the plurality of second ridge-shaped protrusions 141, both of which are provided for reducing the frictional resistance.

As described above, the medal shooting mechanism 130 of the present embodiment includes the upper accumulating part 131 on which a plurality of medals are accumulated. The upper accumulating part 131 makes up the upper flat area 24 of the medal shooting mechanism 130. The medal shooting mechanism 130 includes the lower accumulating part 144 on which a plurality of medals are accumulated. The first lower accumulating part 144 makes up the first lower flat area 27 of the medal shooting mechanism 130. The medal shooting mechanism 130 includes the second lower accumulating part 145 on which a plurality of medals are accumulated. The second lower accumulating part 145 makes up the second lower flat area 28 of the medal shooting mechanism 130.

The medal shooting mechanism 130 further includes the first sloped wall that is continuously sloped down and extended from the first boundary area 132 adjacent to the first lateral portion of the upper accumulating part 131. The first sloped wall makes up the first sloped area 25. The first sloped wall is formed by the first sloped wall lower area 136 and the first sloped wall upper area 134. It is only necessary for the first sloped wall and the second sloped wall to be formed for allowing the game medium to slidingly move upward and slidingly fall along the first sloped wall and the second sloped wall. Therefore, it is not necessarily required for the first sloped wall and the second sloped wall, respectively, to be formed by a sloped plane with predetermined slope angle. For example, the first sloped wall and the second sloped wall may be formed by a sloped-curved surface with non-uniform slope angle, respectively.

As described above, the guides for making the medal as the game medium slidingly roll into the first medal slot 138-1 and the second medal slot 139-1 are formed by the first step 113 and the second step 114 that are linearly sloped down and extended to the first medal slot 138-1 and the second medal slot 139-1, respectively. However, it is not necessarily required for the first step 113 and the second step 114 to be formed linearly sloped down and extended for the purpose of allowing the medal caught by the first step 113 and the second step 114 to slidingly roll into the first medal slot 138-1 and the second medal slot 139-1 under the gravity. In other words, for the purpose of allowing the medal caught by the first step 113 and the second step 114 to slidingly roll into the first medal slot 138-1 and the second medal slot 139-1 under the gravity, it is only necessary for the first step 113 and the second step 114 to be entirely sloped down to the first medal slot 138-1 and the second medal slot 139-1. In short, it is only necessary for the potential energy of the medal M caught by the first step 113 and the second step 114 to be entirely greater than the potential energy of the medal M located in positions of the first medal slot 138-1 and of the second medal slot 139-1. For example, even if a rising portion is formed in the intermediate portion of the first step 113 and the second step 114, when the kinetic energy of the medal M is greater than the sum of the potential energy and the frictional energy of the rising portion, the medal M climbs the rising portion with the momentum of the rotational movement performed so far and then rolls into the first slot. In addition, when a rising portion is formed in the intermediate. portion of the first step 113 and the second step 114 and the kinetic energy of the medal M is less than the sum of the potential energy and the frictional energy of the rising portion, this is not a matter as long as the medal M is capable of climbing the rising portion and then rolling into the first slot by being pushed by another medal M rotationally moving from behind. Also, the first step 113 and the second step 114 may be sloped down and extended in a stepped pattern toward the first medal slot 138-1 and the second medal slot 139-1.

According to the medal shooting mechanism 130 of the above described first embodiment of the present invention, even when a game player continuously shoots the game medium for a long time, it becomes possible to largely reduce game player's tiredness. In addition, a game player does not wear out ones nerves for shooting the game medium, and thus the game player is capable of concentrating on the game itself and really enjoying the game.

Modified Example 1 of Second Embodiment

Figure 16:
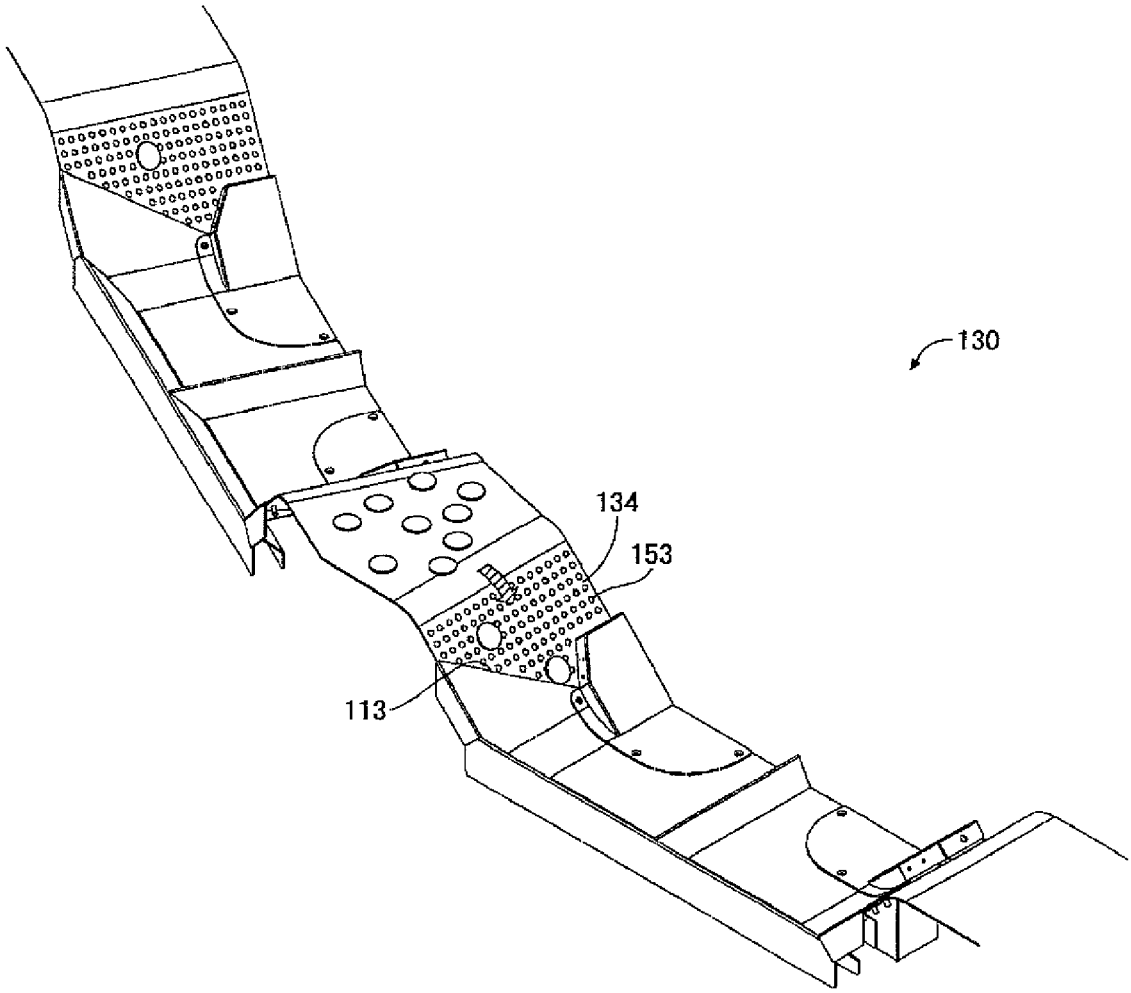
FIG. 16 is a perspective view illustrating a medal shooting mechanism in accordance with a first modified example of the second embodiment of the present invention.

A first modified example of the above described second embodiment will be hereinafter explained with reference to a figure. FIG. 16 is a perspective view illustrating a medal shooting mechanism of the first modification example of the second embodiment of the present invention. Only differences between the above described second embodiment and the fourth modified example are hereinafter explained, and the overlapping explanation will be hereinafter omitted.

A configuration that a plurality of scattered protrusions 153 are formed in the first sloped wall upper area 134 and the second sloped wall upper area 135 instead of forming the above described plurality of first ridge-shaped protrusions 115 and the above described plurality of second ridge-shaped protrusions 116 effectively works for reducing the contact area with the medal M and the first sloped wall upper area 134 and the second sloped wall upper area 135, and furthermore works for reducing the frictional resistance to be generated between the medal M and the first sloped wall upper area 134 and the second sloped wall upper area 135. Here, it is preferable to set intervals between adjacent protrusions 153 to be sufficiently less than diameter dimension of the medal M. Furthermore, it is preferable to form the plurality of protrusions 153 to be regularly scattered at predetermined intervals. With the configuration, the medal M that rolls on the first step 113 and the second step 114 slidingly makes contact with the plurality of scattered protrusions 153. Accordingly, the contact area between the medal M and the first sloped wall upper area 134 and the second sloped wall upper area 135 is reduced, and thus it is possible to effectively reduce the frictional force. From the perspective of reduction of the frictional force, it is preferable to form the plurality of protrusions 153 such that the top thereof is processed to be in a round shape.

Modified Example 2 of Second Embodiment

Figure 17:
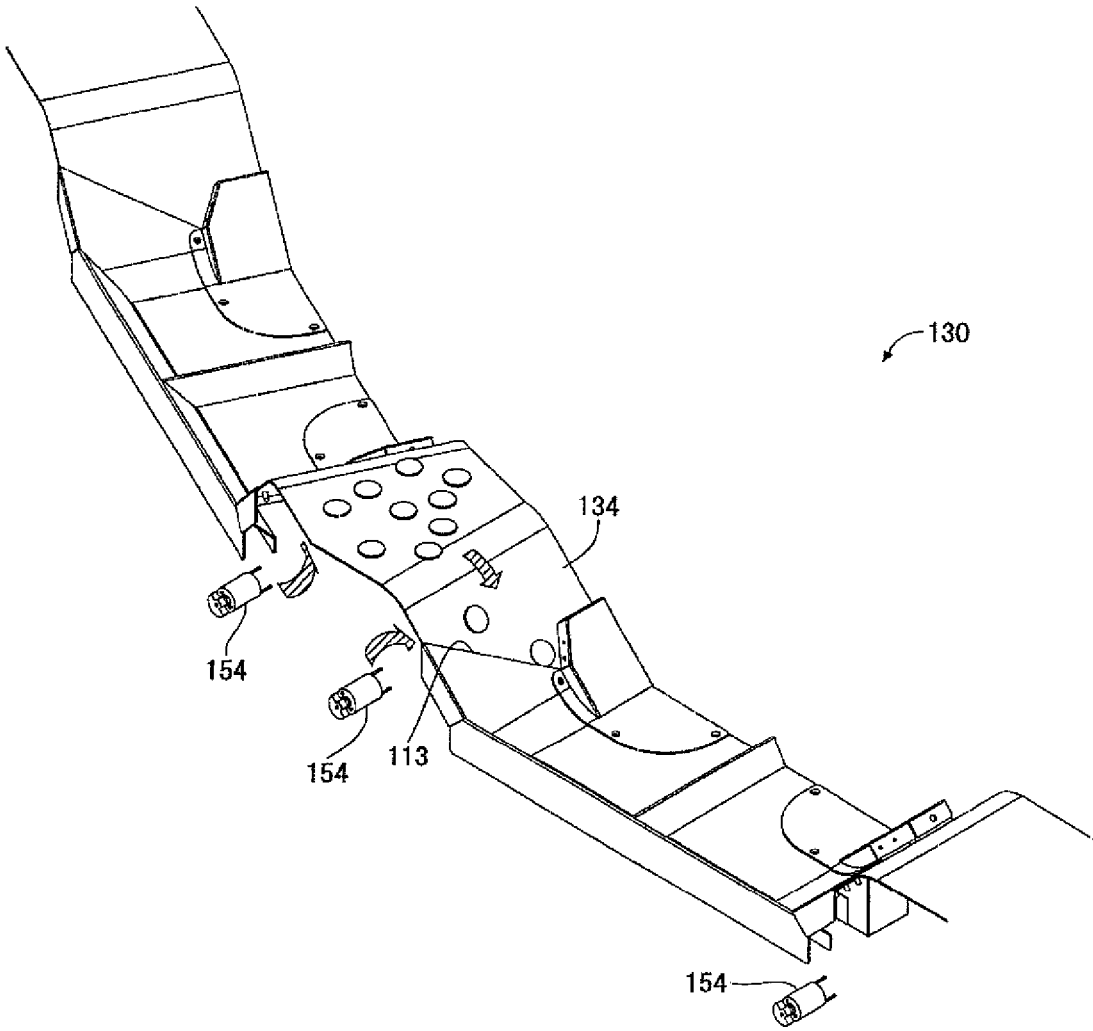
FIG. 17 is a perspective view illustrating a medal shooting mechanism in accordance with a second modified example of the second embodiment of the present invention.

A second modified example of the above described second embodiment will be hereinafter explained with reference to a figure. FIG. 17 is a perspective view illustrating a medal shooting mechanism of the second modified example of the second embodiment of the present invention. Only differences between the above described second embodiment and the fourth modified example are hereinafter explained, and the overlapping explanation will be hereinafter omitted.

A configuration for applying minute vibration to the first sloped wall and the second sloped wall by providing a vibrating motor 154 on the back sides of the first sloped wall and the second sloped wall, respectively, effectively works for reducing the frictional force between the medal M and the first sloped wall and the second sloped wall. The medal M and the first sloped wall and the second sloped wall are prevented from closely making contact with each other by applying minute vibration to the first sloped wall and the second sloped wall. As a result, it becomes possible to reduce the effective contact area between the medal M and the first sloped wall and the second sloped wall, and thus it becomes possible to effectively reduce the frictional force. It should be paid attention for avoiding a situation that the medal M instably rolls along the first step 113 and the second step 114 when too much vibration is applied to the first sloped wall and the second sloped wall. In addition, too much vibration is not preferable because it may make a game player discomfort.

Modified Example 3 of Second Embodiment

Figure 18:
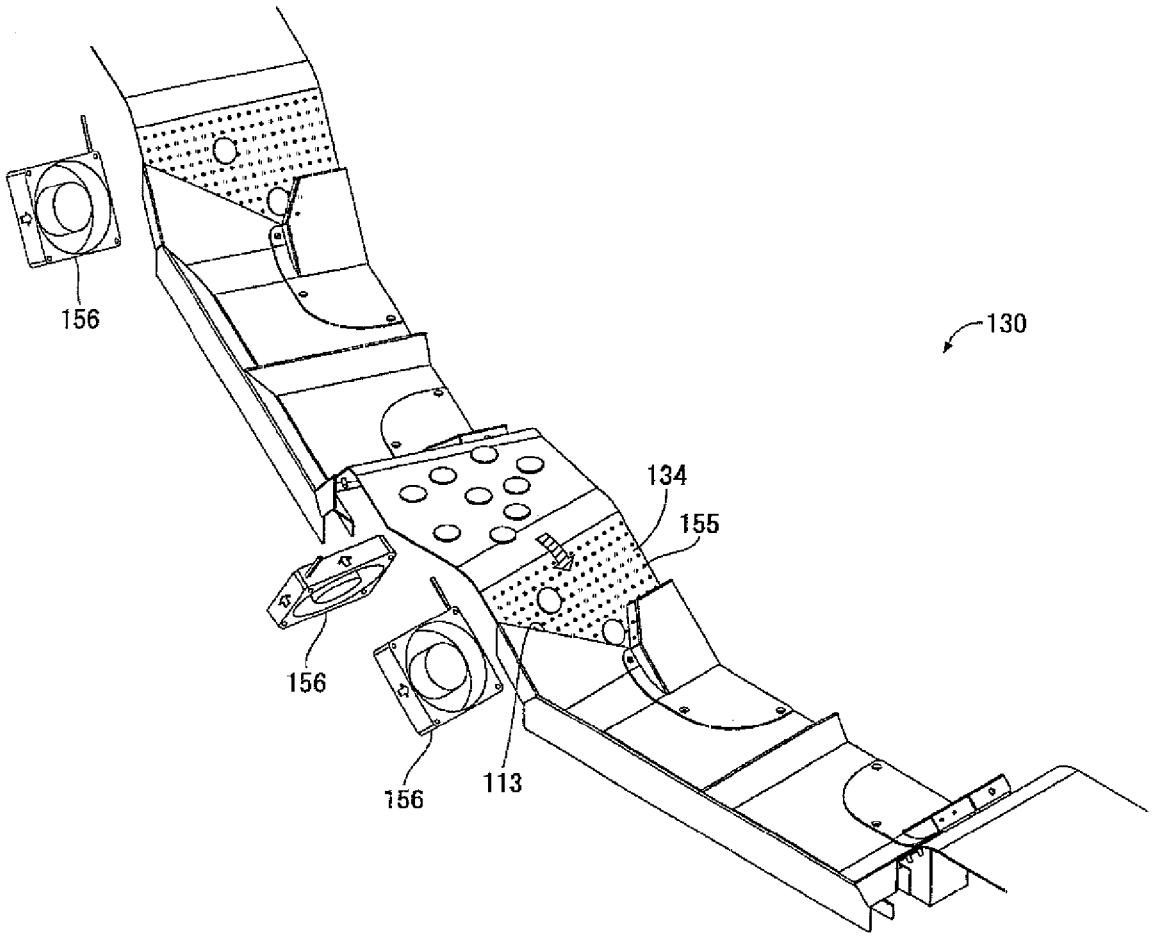
FIG. 18 is a perspective view illustrating a medal shooting mechanism in accordance with a third modified example of the second embodiment of the present invention.

A third modified example of the above described second embodiment will be hereinafter explained with reference to a figure. FIG. 18 is a perspective view illustrating a medal shooting mechanism of the third modified example of the second embodiment of the present invention. Only differences between the above described second embodiment and the fourth modified example are hereinafter explained, and the overlapping explanation will be hereinafter omitted.

In order to reduce the frictional force between the medal M and the first sloped wall and the second sloped wall, the first sloped wall upper area 134 and the second sloped wall upper area 135 have a plurality of scattered vent holes 155, respectively, and a ventilation fan 156 is provided on the back sides of the first sloped wall upper area 134 and the second sloped wall upper area 135, respectively.

Buoyancy for floating the medal M from the first sloped wall upper area 134 and the second sloped wall upper area 135 is applied to the medal M by ventilation through the plurality of vent holes 155. Accordingly, the contact force between the medal M and the first sloped wall upper area 134 and the second sloped wall upper area 135 is reduced. As a result, the frictional force between the medal M and the first sloped wall upper area 134 and the second sloped wall upper area 135 is reduced. Here, it is preferable to set intervals between adjacent vent holes 155 to be sufficiently less than diameter dimension of the medal M. Furthermore, it is preferable to form the plurality of vent holes 155 to be regularly scattered at predetermined intervals. In addition, it is possible to achieve the ventilation fan 156 by disposing it on the back sides of the first sloped wall upper area 134 and the second sloped wall upper area 135, respectively. With the configuration, it becomes possible to efficiently reduce the frictional resistance because the medal M rolls along the first step 113 and the second step 114 in a state that the contact force between the medal M and the first sloped wall upper area 134 and the second sloped wall upper area 135 is reduced by buoyancy applied by the ventilation through the plurality of scattered vent holes 155.

Modified Example 4 of Second Embodiment

Figure 19:
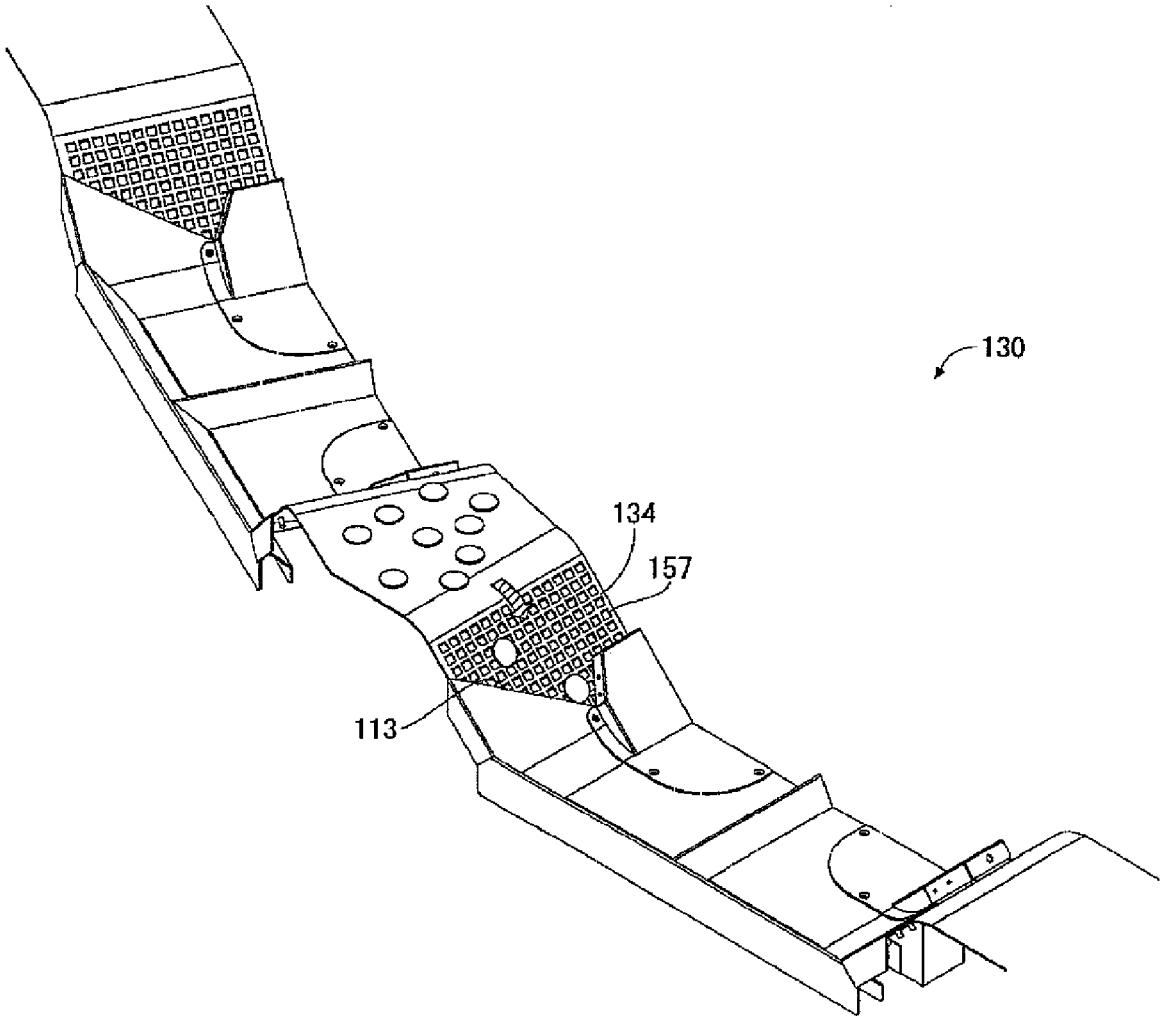
FIG. 19 is a perspective view illustrating a medal shooting mechanism in accordance with a fourth modified example of the second embodiment of the present invention.

A fourth modified example of the above described second embodiment will be hereinafter explained with reference to a figure. FIG. 19 is a perspective view illustrating a medal shooting mechanism of the fourth modified example of the second embodiment of the present invention. Only differences between the above described second embodiment and the fourth modified example are hereinafter explained, and the overlapping explanation will be hereinafter omitted.

It is possible to provide a configuration that the first sloped wall upper area 134 and the second sloped wall upper area 135 are made up of a reticulate sloped wall 157, respectively, as another effective method for reducing the frictional force between the medal M and the first sloped wall and the second sloped wall. Here, reticulated grid intervals are set to be sufficiently less than diameter dimension of the medal M. When the first sloped wall upper area 134 and the second sloped wall upper area 135 are made up of the reticulate sloped wall 157, respectively, the contact area between the medal M and the first sloped wall upper area 134 and the second sloped wall upper area 135 is reduced. Thus it becomes possible to effectively reduce the frictional resistance.

Modified Example 5 of Second Embodiment

Figure 20:
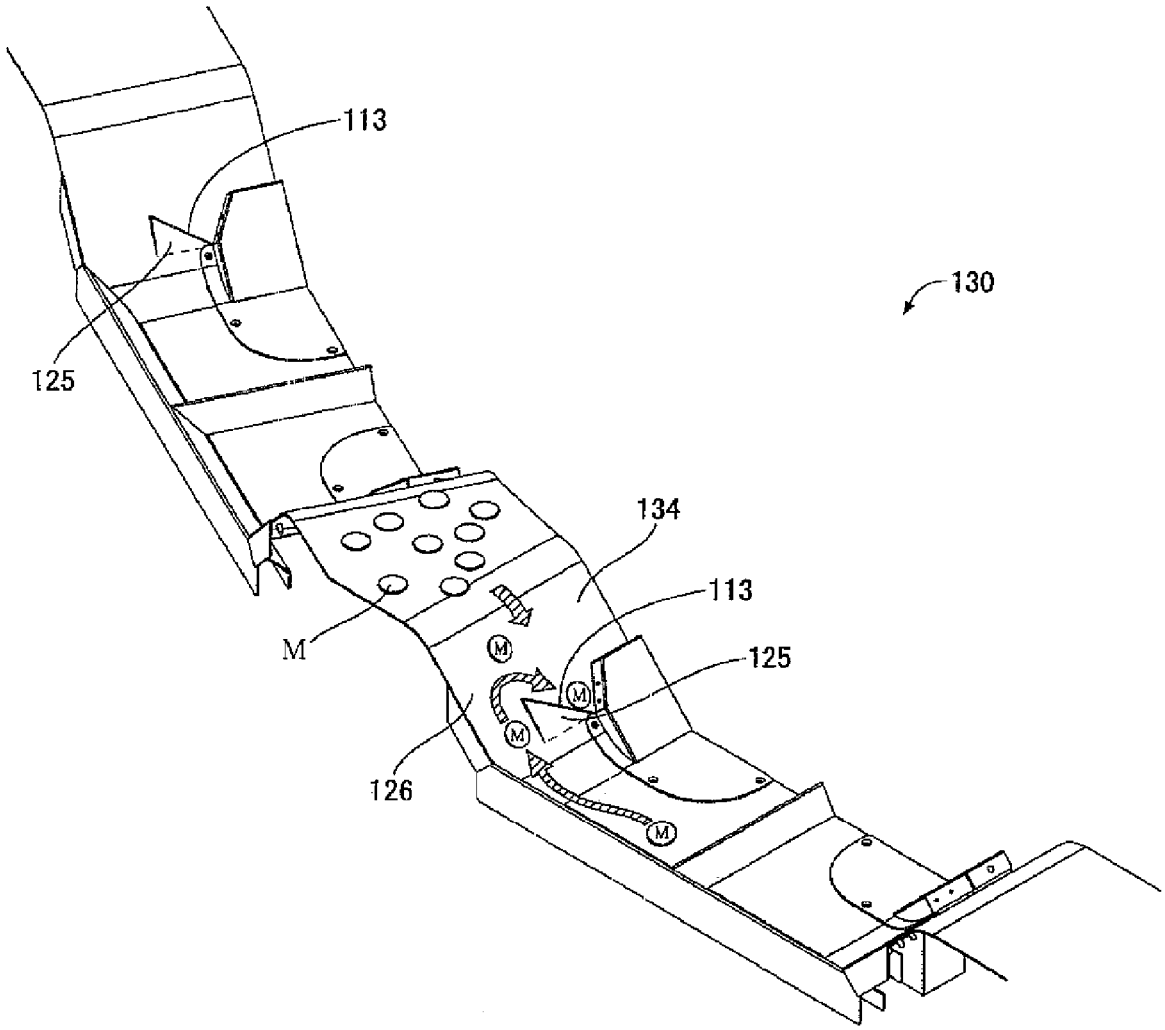
FIG. 20 is a perspective view illustrating a medal shooting mechanism in accordance with a fifth modified example of the first embodiment of the present invention.

A fifth modified example of the above described second embodiment will be hereinafter explained with reference to a figure. FIG. 20 is a perspective view illustrating a medal shooting mechanism of the fifth modified example of the second embodiment of the present invention. Only differences between the above described first embodiment and the fifth modified example are hereinafter explained, and the overlapping explanation will be hereinafter omitted.

In the above described embodiment, each sloped wall is made up of a sloped wall upper area and a sloped wall lower area, and a step making up a guide is formed along a boundary between the sloped wall upper area and the sloped wall lower area. The step is configured to be extended to a medal slot from a lateral portion of the sloped wall upper area that is located on the opposite side from the medal slot. In other words, the step is configured to be extended on the entire area of the sloped wall. On the other hand, according to the modified example 5, it is possible to configure the step to be extended to the medal slot from an inner position that is separated from the lateral portion of the sloped wall upper area located on the opposite side from the medal slot at distance greater than or equal to diameter dimension of the single medal. When the step is extended from the inner position that is separated from the lateral portion of the sloped wall upper area at distance of the diameter dimension of the single medal, it becomes possible to move the medal to the sloped wall upper area through a sloped plane on which a step is not formed.

The above configuration will be hereinafter explained in detail with reference to FIG. 20. The first sloped wall is formed by a first sloped wall upper area 134, a third sloped wall lower area 125, and a fourth sloped wall lower area 126. A first step 113 that makes up the first guide is formed along the boundary between the third sloped wall lower area 125 and the first sloped wall upper area 134. The fourth sloped wall lower area 126 and the first sloped wall upper area 134 form a plane, and no step is formed on the boundary between the fourth sloped wall lower area 126 and the first sloped wall upper area 134. It is possible to form the third sloped wall lower area 125 by an approximately wedge-shaped flat plate that is provided on the single plane formed by the fourth sloped wall lower area 126 and the first sloped wall upper area 134. In this case, thickness of the approximately wedge-shaped flat plate corresponds to the step width of the above described first step 113. Therefore, the thickness is determined based on the step width of the above described first step 113. Furthermore, it is required for the fourth sloped wall lower area 126 to have horizontal dimension greater than diameter dimension of the medal M for the purpose of making the medal M move to the first sloped wall upper area 134 through the fourth sloped wall lower area 126.

With the configuration, a game player may move the medal M from the first accumulating part 144 to the second sloped wall upper area 134 through the fourth sloped wall lower area 126 while the game player presses the medal M with one's finger, and may move it to the second sloped wall upper area 134 through the third sloped wall lower area 125 because no step is formed on the lower side of the third sloped wall lower area 125. When the game player moves the medal M to an upper position of the third sloped wall lower area 125 and then releases the medal M on the position, the medal M slidingly falls along the first sloped wall upper area 134, and is caught by the first step 113 that is made up of the upper side of the approximately wedge-shaped flat plate. Then, as described above, the medal M slidingly rolls into the first medal slot 138-1 along the first step 113.

It is possible to form the third sloped wall lower area 125 by an approximately wedge-shaped plate with non-uniform thickness, instead of the approximately wedge-shaped flat plate. Specifically, it is possible to form the upper side of the approximately wedge-shaped plate to have thickness corresponding to the step width of the above described first step 113. On the other hand, it is possible to form the lower side of the approximately wedge-shaped plate to have thickness of substantially zero by forming the approximately wedge-shaped plate to have thickness gradually reducing from the upper side to the lower side. the configuration, it is not required to form a step on the lower side of the third sloped wall lower area 125.

With the configuration, a game player may move the medal M from the first accumulating part 144 to the second sloped wall upper area 107 through the fourth sloped wall lower area 126 while the game player presses the medal M with one's finger, and may move it to the second sloped wall upper area 107 through the third sloped wall lower area 125 because no step is formed on the lower side of the third sloped wall lower area 125. When the game player moves the medal M to an upper position of the third sloped wall lower area 125 and then releases the medal M on the position, the medal M slidingly falls along the first sloped wall upper area 134, and is caught by the first step 113 that is made up of the upper side of the approximately wedge-shaped flat plate. Then, as described above, the medal M slidingly rolls into the first medal slot 138-1 along the first step 113.

What is claimed is:

1. A game medium shooting mechanism, at least comprising:

a first accumulating part on which an approximately disk-shaped game medium is accumulated;

a first sloped wall being continuously sloped up and extended from the first accumulating part;

a first shooter having a first slot in which the game medium is inserted on a position continuously leading to the first sloped wall;

a first guide being entirely sloped down and extended to the first slot, the first guide having a sloped portion, the sloped portion being sloped down to the first slot, the sloped portion being formed on at least a portion of the first sloped wall for making the game medium slidingly roll into the first slot under the gravity.

2. The game medium shooting mechanism of claim 1, further comprising:

a second sloped wall being positioned on the opposite side from the first sloped wall through the first accumulating part, the second sloped wall being continuously sloped up and extended from the first accumulating part;

a second shooter having a second slot in which the game medium is inserted on a position continuously leading to the second sloped wall;

a sloped wall being sloped down to the second slot, the sloped wall being provided on a portion of the second sloped wall for making the game medium slidingly roll into the second slot under the gravity; and a second guide being entirely sloped down and extended to the second slot.

3. The game medium shooting mechanism of claim 1, further comprising a second accumulating part on which the game medium is accumulated, and wherein the first sloped wall is interposed between the first accumulating part and the second accumulating part, and the first sloped wall is continuously sloped down and extended from the second accumulating part to the first accumulating part.

4. The game medium shooting mechanism of claim 3, further comprising:

a third accumulating part on which the game medium is accumulated, the third accumulating part being positioned on the opposite side from the first accumulating part through the second accumulating part;

a third sloped wall being positioned on the opposite side from the first sloped wall through the second accumulating part, the third sloped wall being interposed between the second accumulating part and the third accumulating part, the third sloped wall being continuously sloped down and extended from the second accumulating part to the third accumulating part;

a third shooter having a third slot in which the game medium is inserted on a position continuously leading to the third sloped wall;

a third guide being entirely sloped down and extended to the third slot, the third guide having a sloped portion, the sloped portion being sloped down to the third slot, the sloped portion being formed on at least a part of the third sloped wall for making the game medium slidingly roll into the third slot under the gravity.

5. The game medium shooting mechanism of one of claims 3-4, wherein a first boundary between the first accumulating part and the first sloped wall, and a second boundary between the second accumulating part and the first sloped wall, are formed to be a curved surface, respectively.

6. The game medium shooting mechanism of claim 1, wherein the first guide is made up of a first step, the first step being formed on the first sloped wall.

7. The game medium shooting mechanism of claim 6, wherein the first step has width approximately corresponding to width of the single game medium.

8. The game medium shooting mechanism of claim 1, wherein the first guide is entirely sloped down and extended from a lateral portion of the first sloped wall to the first slot, the first sloped wall being positioned on the opposite side from the first slot.

9. The game medium shooting mechanism of claim 1, wherein the first guide is entirely sloped down and extended from an inner position to the first slot, the inner position being separated from a lateral portion of the first sloped wall at distance greater than or equal to diameter dimension of the single game medium, the first sloped wall being positioned on the opposite side from the first slope.

10. The game medium shooting mechanism of claim 1, wherein a first boundary between the first accumulating part and the first sloped wall is formed to be a curved surface.

11. The game medium shooting mechanism of claim 1, wherein the first sloped wall includes at least one protrusion, the protrusion being formed for reducing the frictional force to be generated between the first sloped wall and the game medium slidingly rolling along the first guide.

12. The game medium shooting mechanism of claim 11, wherein the at least one protrusion is made up of at least one ridge-shaped protrusion, the ridge-shaped protrusion being separated upward from the first guide at distance less than diameter of the game medium, the ridge-shaped protrusion being extended approximately in parallel with a direction in which the first guide is extended.

13. The game medium shooting mechanism of claim 11, wherein the at least one protrusion is made up of a plurality of protrusions scattered above the first guide.

14. The game medium shooting mechanism of claim 1, further comprising a first vibration device, the first vibration device being configured to apply minute vibration to the first sloped wall.

15. The game medium shooting mechanism of claim 1, wherein the first sloped wall includes a plurality of vent holes scattered above the first guide, and further comprises a first ventilating device, the first ventilating device being configured to ventilate from the back side of the first sloped wall through the plurality of vent holes.

16. The game medium shooting mechanism of claim 1, wherein the first sloped wall is made up of a reticulated sloped wall.

17. The game medium shooting mechanism of claim 1, wherein the first slot of the first shooter has dimension for allowing a single game medium to enter into the slot at a time.

18. The game medium shooting mechanism of claim 1, wherein at least surface of the first sloped wall is made of self-lubricating material.

19. A game device including the game medium shooting mechanism of claim 1.

* * * * *